US009079430B2

(12) United States Patent
Yamaguchi et al.

(10) Patent No.: US 9,079,430 B2
(45) Date of Patent: Jul. 14, 2015

(54) PRINTER WITH FIRST DISCHARGE ROLLER CONNECTED TO SECOND ROLLER BY CONNECTING ARM

(71) Applicant: FUJITSU COMPONENT LIMITED, Tokyo (JP)

(72) Inventors: Toshio Yamaguchi, Tokyo (JP); Sumio Watanabe, Tokyo (JP); Yukihiro Mori, Tokyo (JP); Masaru Kihara, Tokyo (JP); Masahiro Tsuchiya, Tokyo (JP); Yoshinari Takabatake, Tokyo (JP); Tetsuhiro Ishikawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/332,504

(22) Filed: Jul. 16, 2014

(65) Prior Publication Data

US 2014/0327203 A1 Nov. 6, 2014

Related U.S. Application Data

(63) Continuation of application No. PCT/JP2013/050997, filed on Jan. 18, 2013.

(30) Foreign Application Priority Data

Jan. 19, 2012 (JP) ..... 2012-009440

(51) Int. Cl.

| | |
|---|---|
| ***B41J 11/70*** | (2006.01) |
| ***B41J 13/02*** | (2006.01) |
| ***B65H 29/58*** | (2006.01) |
| ***B65H 29/60*** | (2006.01) |
| ***B41J 13/00*** | (2006.01) |
| ***B41J 11/66*** | (2006.01) |

(52) U.S. Cl.

CPC ..... *B41J 13/009* (2013.01); *B41J 11/663* (2013.01); *B41J 11/70* (2013.01); *B41J 13/025* (2013.01); *B65H 29/58* (2013.01); *B65H 29/60* (2013.01)

(58) Field of Classification Search

CPC ..... B41J 11/70; B41J 13/025; B41J 13/009; B65H 29/58; B65H 29/60

See application file for complete search history.

(56) References Cited

U.S. PATENT DOCUMENTS 5,215,298 A * 6/1993 Stemmle et al. ..... 271/65
5,588,762 A 12/1996 Suzuki
5,931,458 A * 8/1999 Morimoto ..... 271/186

(Continued)

FOREIGN PATENT DOCUMENTS

CN 1150931 6/1997
JP H10-273260 10/1998

(Continued)

OTHER PUBLICATIONS

International Search Report mailed on Feb. 12, 2013.

*Primary Examiner* — Daniel J Colilla
(74) *Attorney, Agent, or Firm* — IPUSA, PLLC

(57) ABSTRACT

A printer includes a printing part that performs printing on recording paper, a cutter that cuts the recording paper, a first roller provided on the side to which the recording paper is discharged from the cutter, a second roller, a third roller, a fourth roller, and a fifth roller that are in contact with the first roller and are rotated by the rotation of the first roller, and a connecting arm that connects the center of the first roller and the center of the second roller, wherein the recording paper is discharged between the first roller and the fourth roller or between the first roller and the fifth roller.

10 Claims, 41 Drawing Sheets

(56) References Cited

U.S. PATENT DOCUMENTS

| | | | | |
|---|---|---|---|---|
| 6,371,481 | B1 * | 4/2002 | Miyake | 271/314 |
| 6,814,515 | B2 | 11/2004 | Tsuchiya et al. | |
| 7,857,534 | B2 | 12/2010 | Watanabe et al. | |
| 2009/0190982 | A1 | 7/2009 | Yamamoto | |
| 2011/0211890 | A1 | 9/2011 | Shigeno et al. | |

FOREIGN PATENT DOCUMENTS

| | | |
|---|---|---|
| JP | 2003-019845 | 1/2003 |
| JP | 2007-130842 | 5/2007 |
| JP | 2009-179414 | 8/2009 |
| JP | 2011-240997 | 12/2011 |

* cited by examiner

PRINTER WITH FIRST DISCHARGE ROLLER CONNECTED TO SECOND ROLLER BY CONNECTING ARM

CROSS-REFERENCE TO RELATED APPLICATIONS

The present application is a continuation application filed under 35 U.S.C. 111(a) claiming benefit under 35 U.S.C. 120 and 365(c) of PCT International Application No. PCT/JP2013/050997, filed on Jan. 18, 2013 and designating the U.S., which claims priority to Japanese Patent Application No. 2012-009440, filed on Jan. 19, 2012. The entire contents of all of the foregoing applications are incorporated herein by reference.

BACKGROUND OF THE INVENTION

1. Field of the Invention

The present invention relates to printers and methods of controlling a printer.

2. Description of the Related Art

Printers that output receipts are widely used for shop registers and automated teller machines (ATMs) or cash dispensers (CDs) in banks.

In such printers that output receipts, thermal paper serving as recording paper is wound in a roll, and printing is performed on the recording paper with a thermal head while conveying the recording paper. After conveying the recording paper a predetermined length, the recording paper is cut with a cutter to the predetermined length.

Some of these printers that output receipts include a presenter in order to prevent recording paper from being pulled out during printing or cutting with a cutter. The presenter is provided so that the recording paper subjected to printing enters the presenter to be cut and thereafter discharged from the presenter.

In addition to a function as a presenter, some presenters have a function as a retractor in order to prevent discharged recording paper, that is, a printed receipt or the like, that has been left behind, from being taken away by others.

Reference may be made to Japanese Laid-Open Patent Application No. 2003-19845 and Japanese Laid-Open Patent Application No. 2007-130842 for related art.

SUMMARY OF THE INVENTION

According to an aspect of the present invention, a printer includes a printing part that performs printing on recording paper, a cutter that cuts the recording paper, a first roller provided on the side to which the recording paper is discharged from the cutter, a second roller, a third roller, a fourth roller, and a fifth roller that are in contact with the first roller and are rotated by the rotation of the first roller, and a connecting arm that connects the center of the first roller and the center of the second roller, wherein the recording paper is discharged between the first roller and the fourth roller or between the first roller and the fifth roller.

A method of controlling a printer of the present invention includes conveying first recording paper cut with a cutter between a first roller and a second roller and between the first roller and a fourth roller by rotating the first roller in a first rotation direction, wherein the first roller is provided on the side to which recording paper is discharged from the cutter part, the second roller is in contact with the first roller and is rotated by the rotation of the first roller, and the center of the second roller is connected to the center of the first roller, moving the second roller on the outer periphery of the first roller by rotating the first roller in a second rotation direction opposite to the first rotation direction, and conveying second recording paper cut with the cutter between the first roller and a third roller and between the first roller and a fifth roller by rotating the first roller in the second rotation direction.

DESCRIPTION OF EMBODIMENTS

Figure 1:
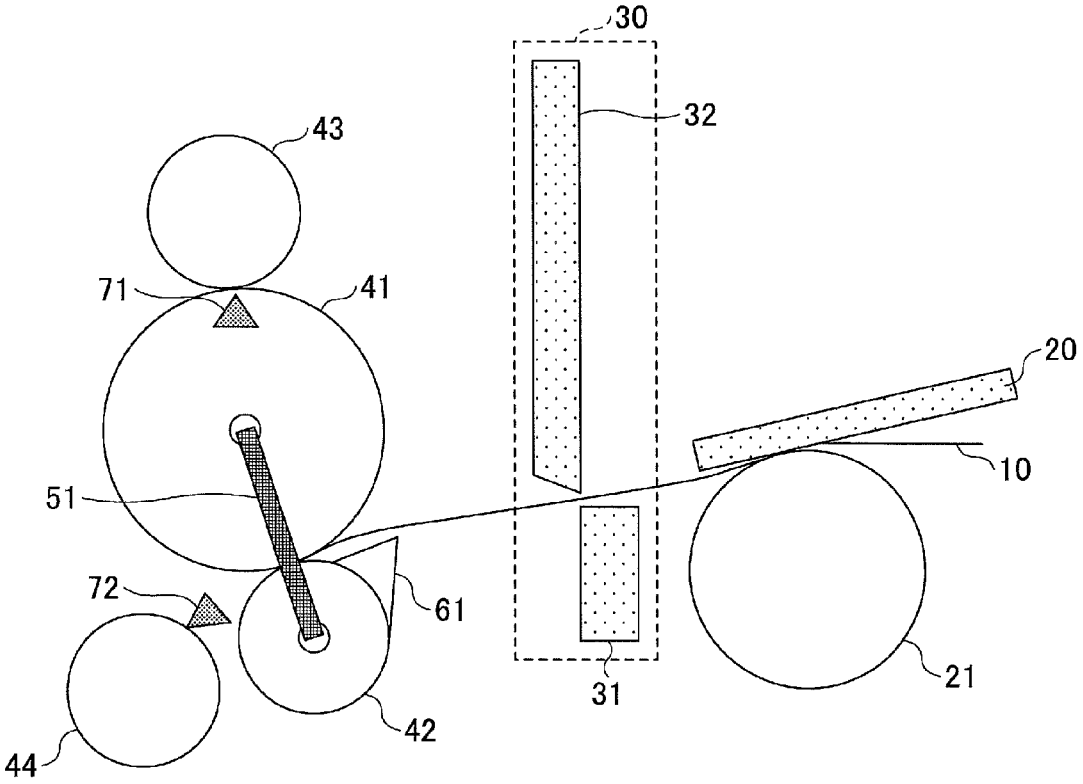
FIG. 1 is a structural diagram of a printer of a first embodiment.

Embodiments of the present invention are described below with reference to the accompanying drawings. The same members are referred to by the same reference numerals, and their description is omitted.

First Embodiment

[Printer Structure]

First, a printer structure in this embodiment is described based on FIG. 1. A printer of this embodiment includes a thermal head 20 that prints characters on recording paper 10 wound in a roll and a cutter part 30 that cuts the recording paper 10 subjected to printing in the thermal head 20 to a predetermined length. The recording paper 10 is thermal paper, and is subjected to printing by the thermal head 20 with the recording paper 10 being held between the thermal head 20 and a platen roller 21. The cutter part 30 includes a fixed blade 31 and a movable blade 32. The movable blade 32 moves relative to the fixed blade 31, so that it is possible to cut the recording paper 10 subjected to printing to a predetermined length.

In the printer of this embodiment, a first roller 41, a second roller 42, a third roller 43, and a fourth roller 44 for discharging the recording paper 10 subjected to printing are provided outside the cutter part 30. The first roller 41 may be rotated by a drive part that is not illustrated in the drawing. The second roller 42 is in contact with the first roller 41, and is rotated by the rotation of the first roller 41. The third roller 43 is in contact with the first roller 41, and is rotated by the rotation of the first roller 41. The center of the second roller 42 and the center of the first roller 41 are connected to one end and the other end of a connecting arm 51, respectively, and it is possible for the second roller 42 to move on the outer periphery of the first roller 41.

Furthermore, the second roller 42 is provided with a recording paper guide 61 in order to make it possible to smoothly guide the recording paper 10 to the second roller 42. Furthermore, sensors 71 and 72 for detecting the presence or absence of the recording paper 10 are provided at predetermined positions.

The printer of this embodiment implements functions as a presenter and a retractor with the first roller 41, the second roller 42, the third roller 43, the fourth roller 44, the connecting arm 51, the recording paper guide 61, and the sensors 71 and 72.

[Printer Operations]

Figure 2:
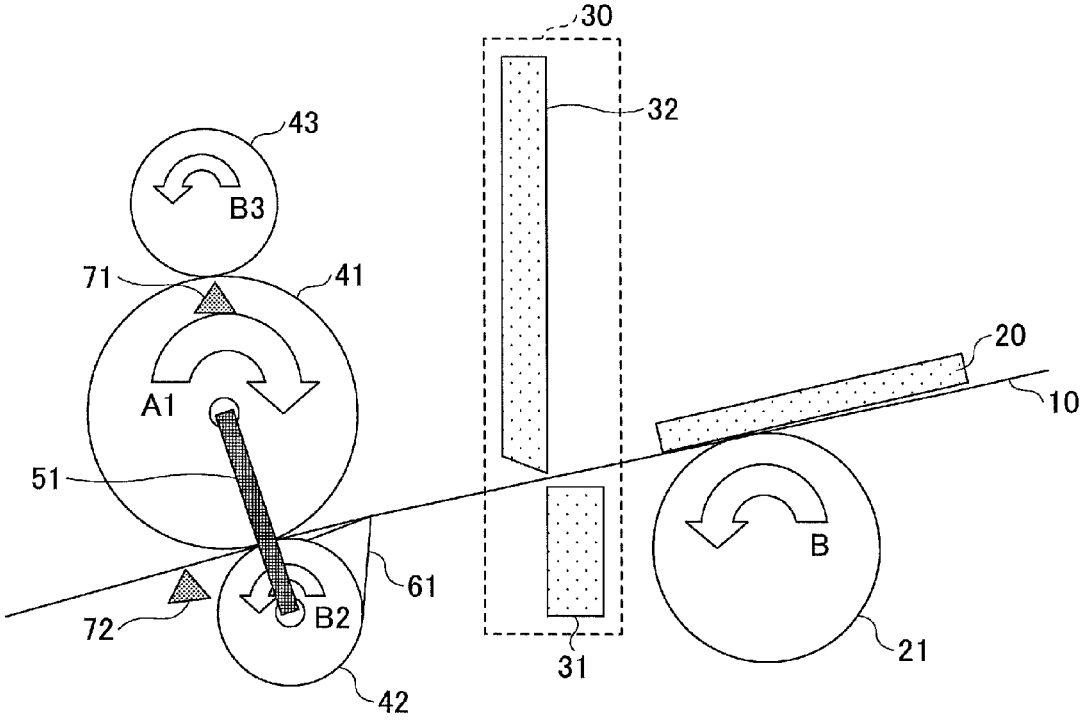
FIG. 2 is a diagram illustrating a method of discharging normal recording paper of a printer of the first embodiment.

Next, printer operations of this embodiment are described. First, the case of discharging the recording paper 10 without implementing a function as a presenter in a printer of this embodiment is described. In this case, as illustrated in FIG. 2, the recording paper 10 subjected to printing by the thermal head 20 is discharged through the cutter part 30 with the recording paper 10 being held between the first roller 41 and the second roller 42.

Specifically, when printing is performed on the recording paper 10 by the thermal head 20, the platen roller 21 rotates counterclockwise as indicated by arrow B, so that the recording paper 10 is conveyed through the cutter part 30 to the side on which the first roller 41 is provided. The second roller 42 is provided with the recording paper guide 61, and the recording paper 10 is conveyed along the recording paper guide 61 so as to enter between the first roller 41 and the second roller 42. That is, by rotating the first roller 41 clockwise as indicated by arrow A1, it is possible to rotate the second roller 42 counterclockwise as indicated by arrow B2. As a result, it is possible to hold the recording paper 10 between the first roller 41 and the second roller 42, and further to convey the recording paper 10 with the first roller 41 and the second roller 42 in a direction to discharge the recording paper 10. At this point, the third roller 43 is rotating counterclockwise as indicated by arrow B3. It is possible to detect with the sensor 72 whether the discharge of the recording paper 10 has started and whether the discharge of the recording paper 10 has ended. In this embodiment, one rotation direction may be described as a clockwise rotation direction, and the other rotation direction may be described as a counterclockwise rotation direction. The one rotation direction and the other rotation direction are rotation directions opposite to each other, either of which may be determined as the clockwise rotation direction. Furthermore, in FIG. 2, the fourth roller 44 is omitted.

Next, the case of discharging the recording paper 10 by causing a presenter to function in a printer of this embodiment is described based on FIGS. 3A through 3G. Unnecessary members in each process may be omitted in the drawings.

Figure 3A:
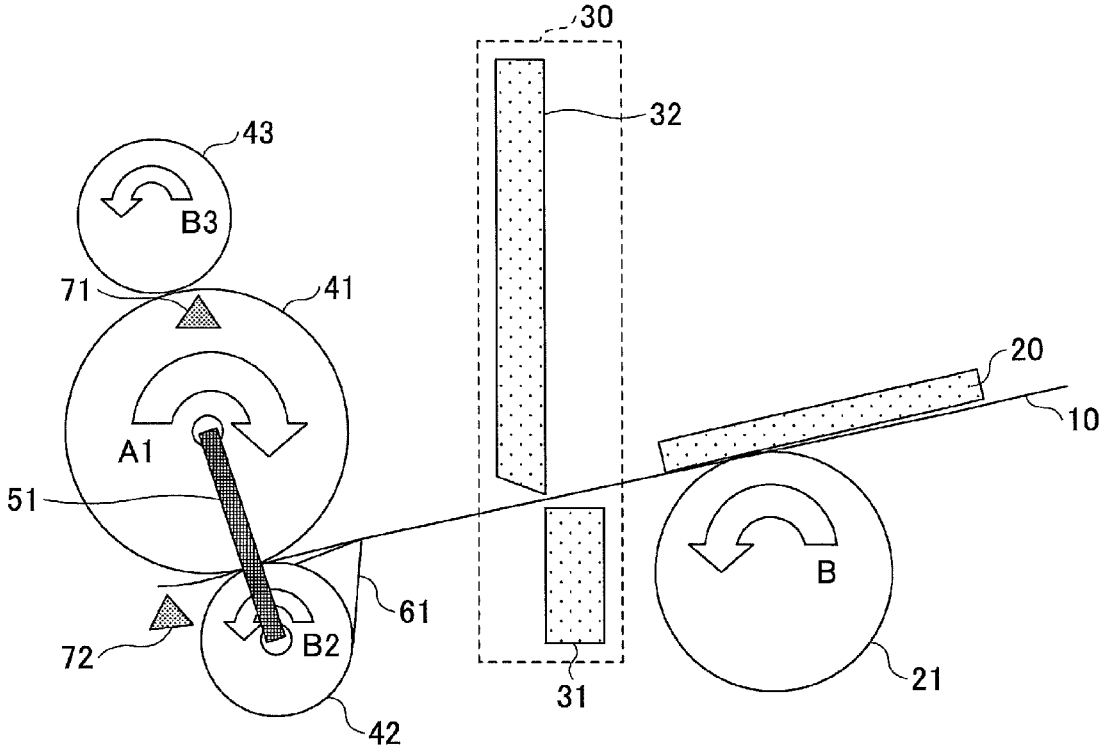
FIG. 3A is a diagram illustrating a presenter function of a printer of the first embodiment.

First, as illustrated in FIG. 3A, when printing is performed on the recording paper 10 by the thermal head 20, the platen roller 21 rotates counterclockwise as indicated by arrow B, so that the recording paper 10 is conveyed through the cutter part 30 to the side on which the first roller 41 is provided. The second roller 42 is provided with the recording paper guide 61, and the recording paper 10 is conveyed along the recording paper guide 61 so as to enter between the first roller 41 and the second roller 42. That is, by rotating the first roller 41 clockwise as indicated by arrow A1, the second roller 42 rotates counterclockwise as indicated by arrow B2, so that it is possible to hold the recording paper 10 between the first roller 41 and the second roller 42. At this point, the second roller 42 is rotating at the position illustrated in FIG. 3A by coming into contact with the fourth roller 44 not illustrated in the drawing or by the connecting arm 51 being formed so as to prevent its position from rotating clockwise from the state illustrated in FIG. 3A.

Figure 3B:
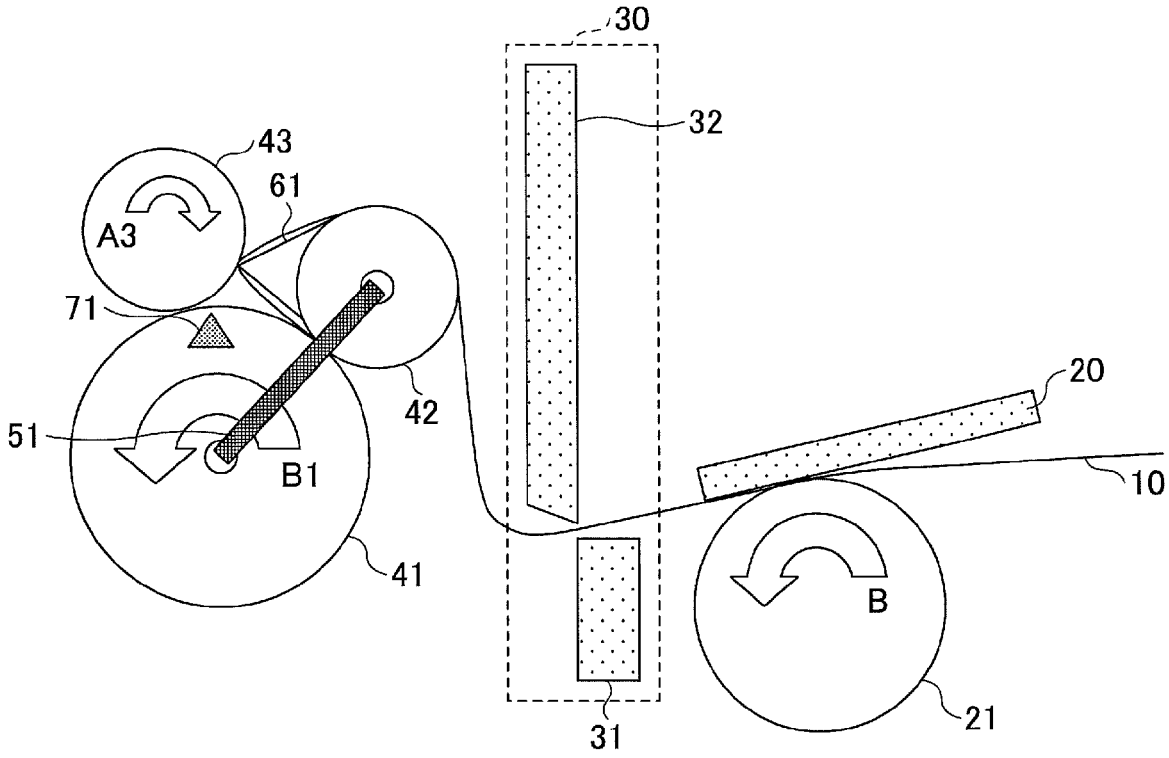
FIG. 3B is a diagram illustrating the presenter function of a printer of the first embodiment.

Next, as illustrated in FIG. 3B, the first roller 41 is rotated counterclockwise as indicated by arrow B1. As a result, the second roller 42, whose center is connected to the center of the first roller 41 by the connecting arm 51, moves counterclockwise on the outer periphery of the first roller 41 with an end portion of the recording paper 10 being held between the first roller 41 and the second roller 42. Specifically, the second roller 42 moves until the recording paper guide 61 provided on the second roller 42 comes into contact with the third roller 43 through the recording paper 10.

Figure 3C:
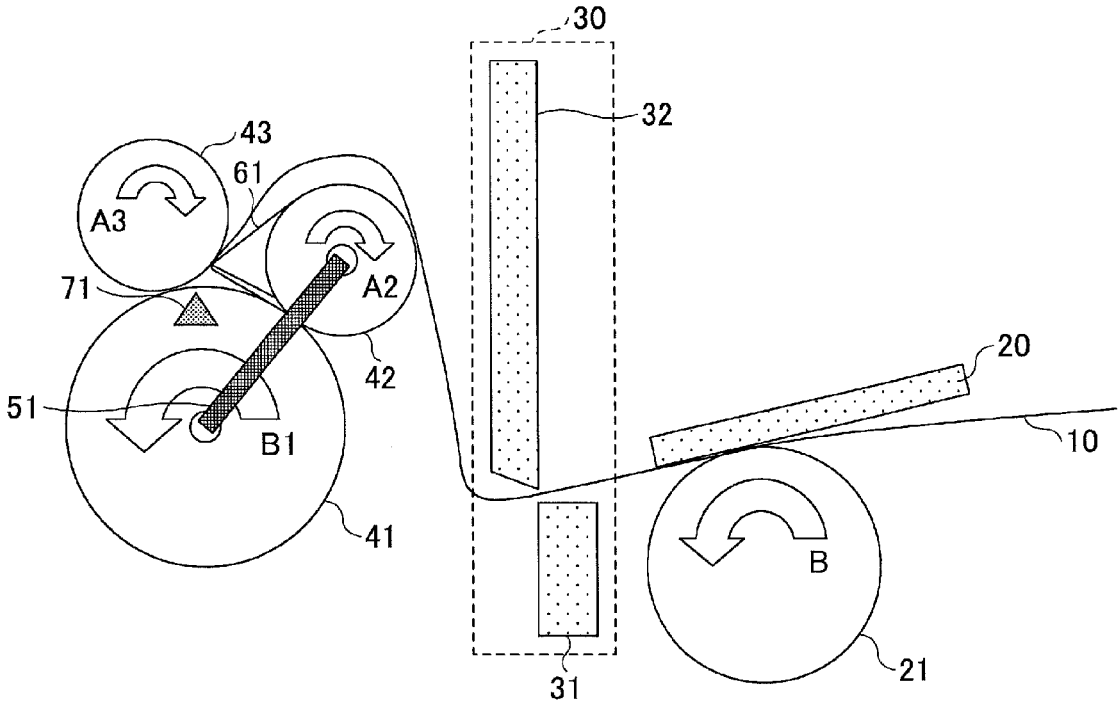
FIG. 3C is a diagram illustrating the presenter function of a printer of the first embodiment.

Next, as illustrated in FIG. 3C, the first roller 41 is rotated counterclockwise as indicated by arrow B1. By rotating the first roller 41 counterclockwise as indicated by arrow B1, the third roller 43 rotates clockwise as indicated by arrow A3, and as a result, the recording paper 10, which is brought into contact with the third roller 43 by the recording paper guide 61, is held between the first roller 41 and the third roller 43 by the rotation of the third roller 43. At this point, the second roller 42 is prevented from moving counterclockwise from the position illustrated in FIG. 3C, and therefore, the second roller 42 rotates clockwise as indicated by arrow A2 at the position illustrated in FIG. 3C.

Figure 3D:
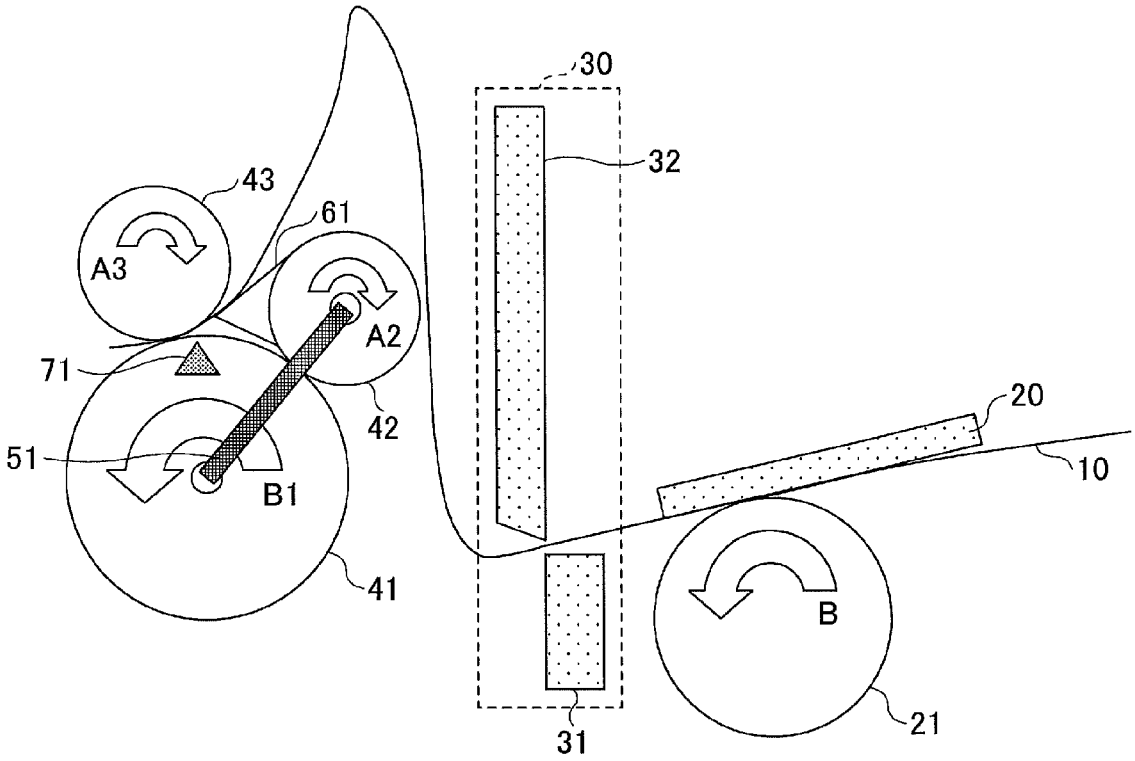
FIG. 3D is a diagram illustrating the presenter function of a printer of the first embodiment.

Next, as illustrated in FIG. 3D, printing continues to be performed on the recording paper 10 by the thermal printer 20. At this point, if the rotation of the first roller 41 is stopped, the recording paper 10 subjected to printing remains between the cutter part 30 and the first roller 41 because the platen roller 21 is rotating counterclockwise as indicated by arrow B. Furthermore, if the first roller 41 is rotated counterclockwise without being stopped, the recording paper 10 is conveyed in a direction to discharge the recording paper 10 by the first roller 41 and the third roller 43.

Figure 3E:
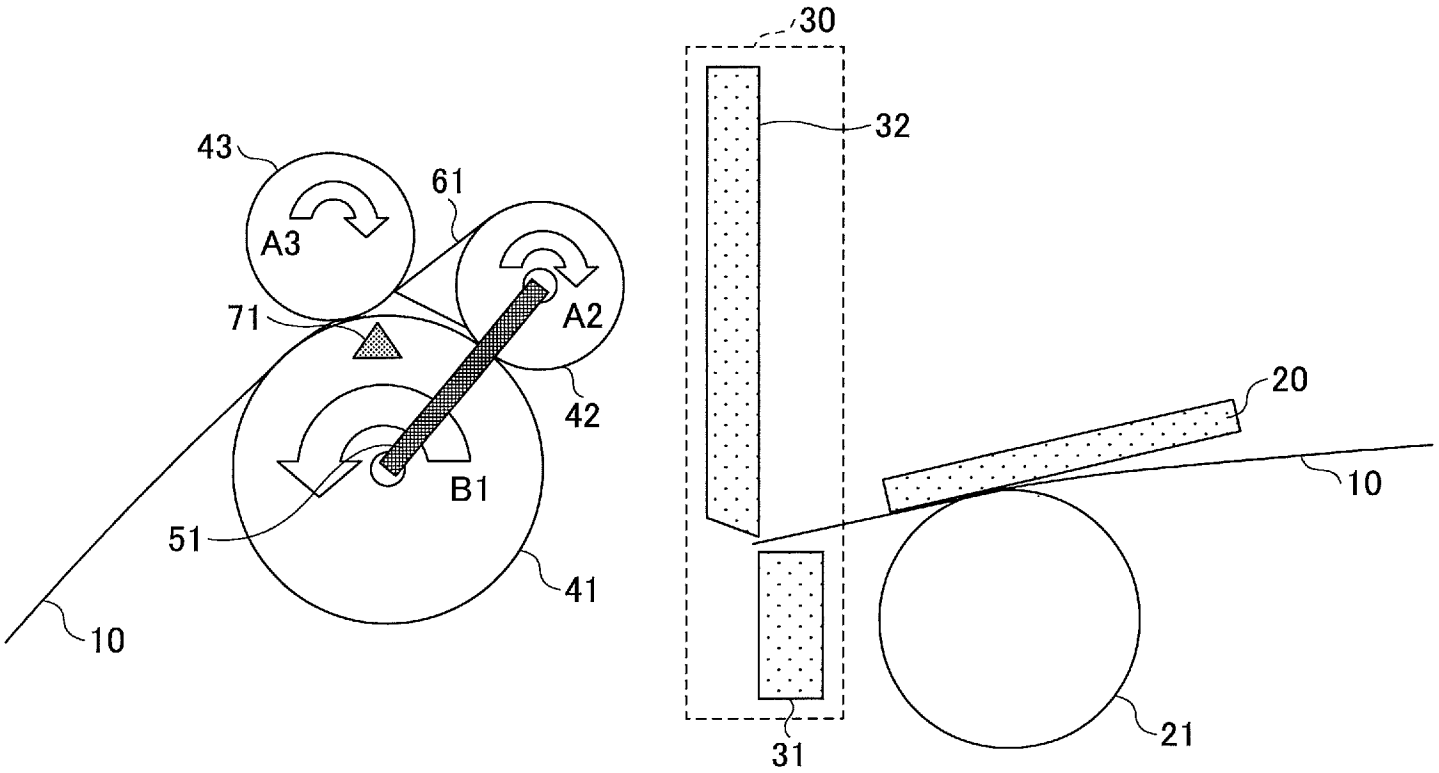
FIG. 3E is a diagram illustrating the presenter function of a printer of the first embodiment.

Next, as illustrated in FIG. 3E, after the completion of predetermined printing on the recording paper 10, the recording paper 10 is cut in the cutter part 30, and the recording paper 10 is conveyed up to a position where it is possible to remove the recording paper 10 by rotating the first roller 41 counterclockwise as indicated by arrow B1. In this state, the recording paper 10 subjected to printing is ready to be removed, and the rotation of the first roller 41 is stopped in order to maintain this state for a predetermined time. In this state, if the recording paper 10 subjected to printing is removed, the process of printing and discharging ends. On the other hand, if the recording paper 10 is not removed even after passage of the predetermined time, an operation to collect the recording paper 10 is performed.

Figure 3F:
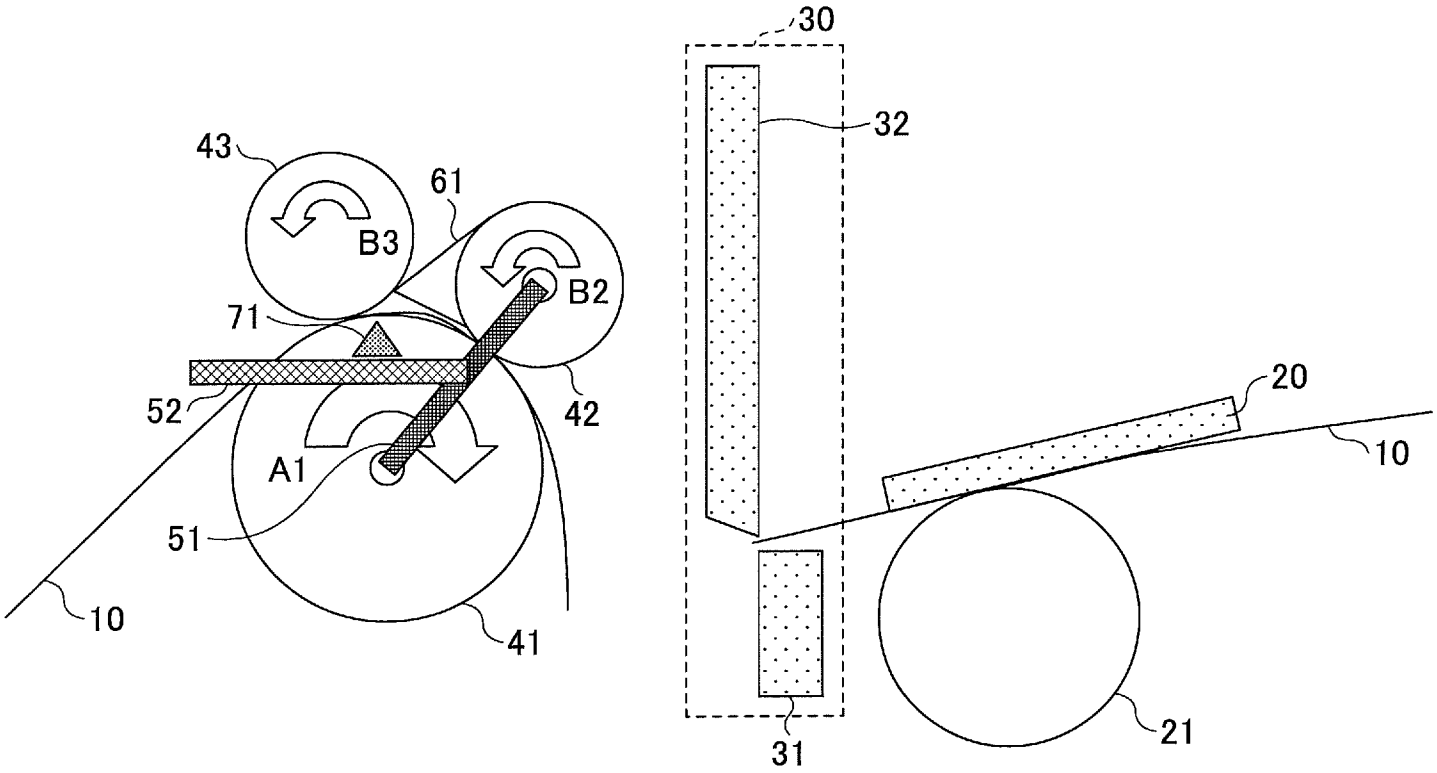
FIG. 3F is a diagram illustrating the presenter function of a printer of the first embodiment.

Specifically, as illustrated in FIG. 3F, the first roller 41 is rotated clockwise as indicated by arrow A1. At this point, the connecting arm 51 is locked at a predetermined position by a lock part 52, so that the position of the second roller 42 is fixed, and therefore, the second roller 42 rotates at this position. That is, by rotating the first roller 41 clockwise as indicated by arrow A1, the second roller 42 rotates counterclockwise as indicated by arrow B2, and the recording paper 10 subjected to printing held between the first roller 41 and the third roller 43 is conveyed by the first roller 41 and the third roller 43 to be held between the first roller 41 and the second roller 42. The connecting arm 51 continues to be locked at the predetermined position by the lock part 52 until the recording paper 10 is held between the first roller 41 and the second roller 42. Thereafter, by releasing the connecting arm 51 locked by the lock part 52, the second roller 42 whose center is connected to the center of the first roller 41 by the connecting arm 51 moves clockwise on the outer periphery of the first roller 41 because the first roller 41 is rotating clockwise as indicated by arrow A1. The measure for locking the connecting arm 51 at the above-described predetermined position is not limited to the lock part 52, and may be any measure having a similar function, for example, any measure having a mechanism capable of fixing the second roller 42 at a predetermined position and rotating the second roller 42 at the position at which the second roller 42 is fixed.

Figure 3G:
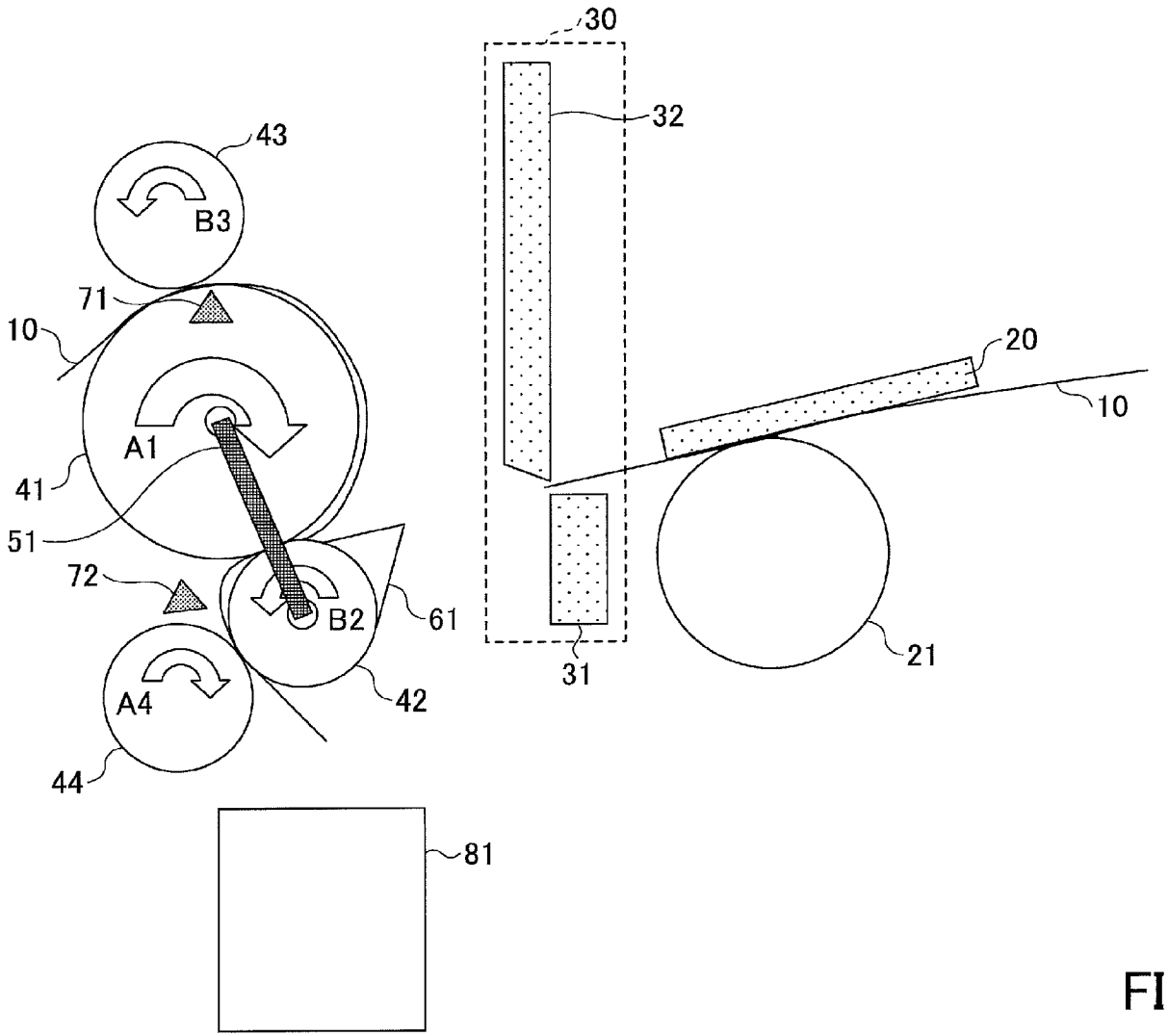
FIG. 3G is a diagram illustrating the presenter function of a printer of the first embodiment.

Next, as illustrated in FIG. 3G, by further rotating the first roller 41 clockwise as indicated by arrow A1 from the state illustrated in FIG. 3F, the second roller 42 is moved to a position where the second roller 42 comes into contact with the fourth roller 44. In this state, because the first roller 41 is rotating clockwise as indicated by arrow A1, the second roller 42 is rotating counterclockwise as indicated by arrow B2. Furthermore, the fourth roller 44 is a roller that rotates by contacting the second roller 42, and as a result of the second roller 42 rotating counterclockwise as indicated by arrow B2, the fourth roller 44 rotates clockwise as indicated by arrow A4, so that the recording paper 10 is held between the second roller 42 and the fourth roller 44. Thereafter, the recording paper 10 held between the second roller 42 and the fourth roller 44 is conveyed to and collected into a retractor box 81 by the counterclockwise rotation of the second roller 42 as indicated by arrow B2 and the clockwise rotation of the fourth roller 44 as indicated by arrow A4.

Figure 4A:
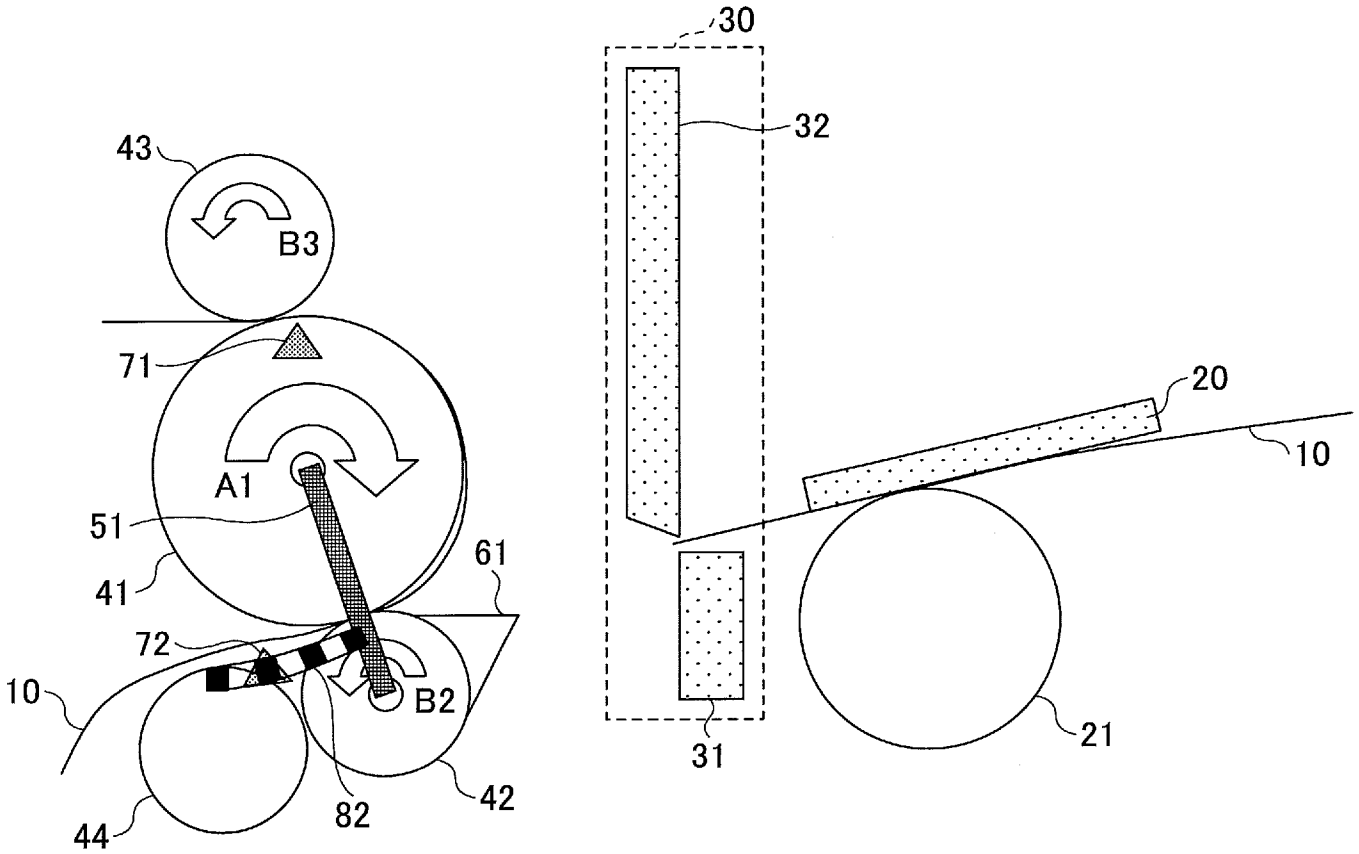
FIG. 4A is a diagram illustrating a recording paper switching guide of a printer of the first embodiment.
Figure 4B:
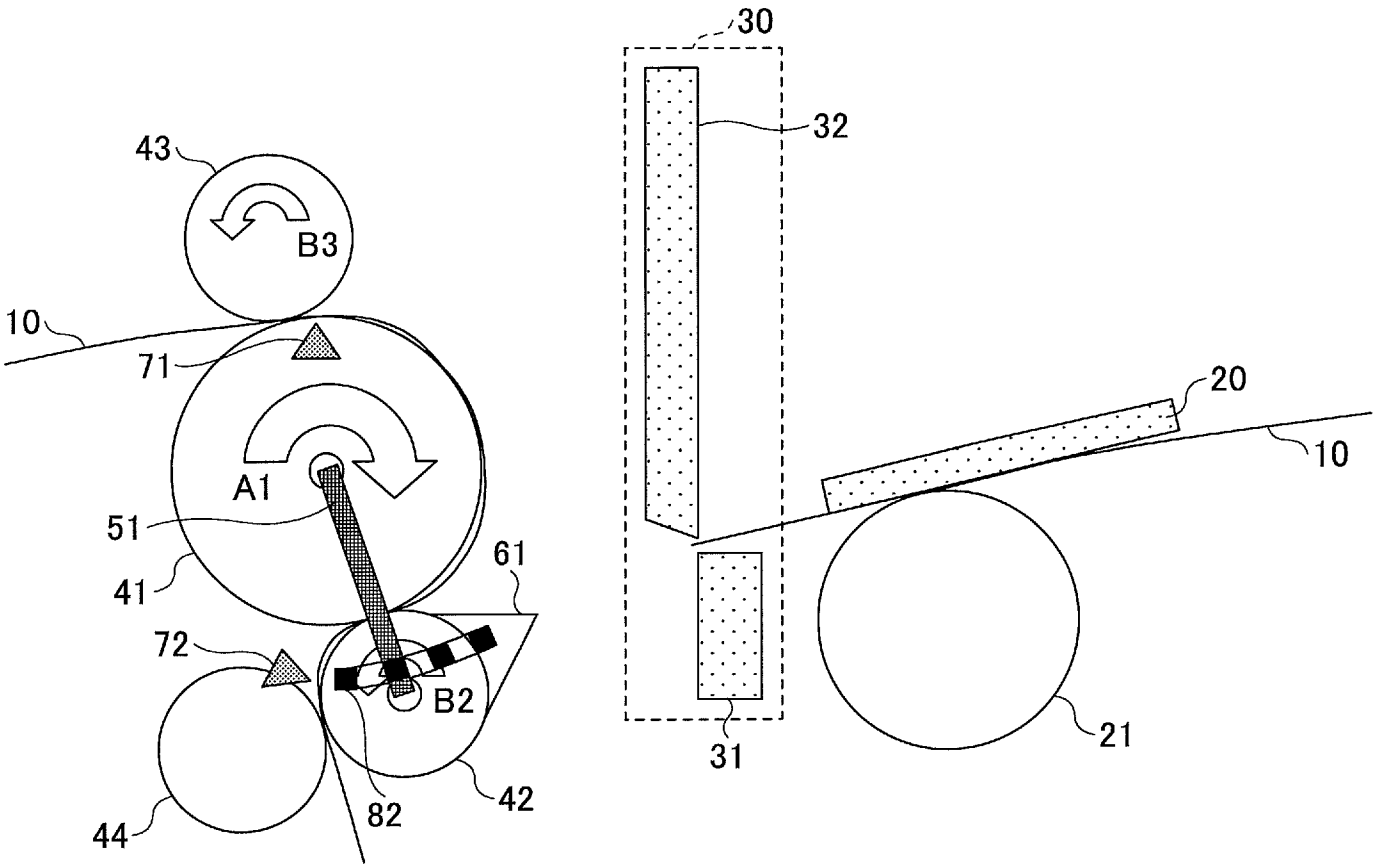
FIG. 4B is a diagram illustrating the recording paper switching guide of a printer of the first embodiment.

The printer of this embodiment may be provided with a recording paper switching guide 82 capable of changing the discharge direction of the recording paper 10 as illustrated in FIGS. 4A and 4B. Specifically, with the recording paper switching guide 82 being moved to a position over (an entrance opening between) the second roller 42 and the fourth roller 44 as illustrated in FIG. 4A, it is possible to discharge the recording paper 10 between the first roller 41 and the second roller 42 and between the first roller 41 and the fourth roller 44. Furthermore, with the recording paper switching guide 82 being moved from the position illustrated in FIG. 4A to the side on which the cutter part 30 is provided as illustrated in FIG. 4B, it is possible to discharge the recording paper 10 between the first roller 41 and the second roller 42 and between the second roller 42 and the fourth roller 44. By thus moving the position of the recording paper switching guide 82, it is possible to select a direction to discharge the collected recording paper 10.

The printer of this embodiment implements functions as a presenter and a retractor with the first roller 41, the second roller 42, the third roller 43, and the fourth roller 44. Therefore, it is possible to reduce the size of a printer having a presenter function.

Second Embodiment

Next, a second embodiment is described. This embodiment relates to a method of controlling a printer of the first embodiment. In order to describe a method of controlling a printer of this embodiment, a structure of a printer of this embodiment is described based on FIG. 5. This printer includes a first sensor S1 and a second sensor S2 that detect the presence or absence of entry of the recording paper 10 from the cutter part 30. The first sensor S1 is a reflective sensor, and the second sensor S2 is a sensor that detects transmitted light. It is possible to determine the conditions of the recording paper 10 such as the presence or absence of the recording paper 10 and the paper quality of the recording paper 10 with the first sensor S1 and the second sensor S2. Furthermore, the printer includes a third sensor S3 for detecting whether the recording paper 10 is discharged from a first discharge opening 301, a fourth sensor S4 for detecting whether the recording paper 10 is discharged from a second discharge opening 302, a fifth sensor S5 for detecting whether the recording paper 10 is discharged from a third discharge opening 303, and a sixth sensor S6 for detecting whether the recording paper 10 is retracted. Furthermore, the printer includes a seventh sensor S7 and an eighth sensor S8 for detecting the position of the connecting arm 51 connecting the first roller 41 and the second roller 42. The fourth sensor S4 of this embodiment corresponds to the sensor 71 of the first embodiment, and the third sensor S3 of this embodiment corresponds to the sensor 72 of the first embodiment. Furthermore, the printer is provided with a fifth roller 45 that rotates by contacting the third roller 43 in addition to the first roller 41, the second roller 42, the third roller 43, and the fourth roller 44.

Figure 5:
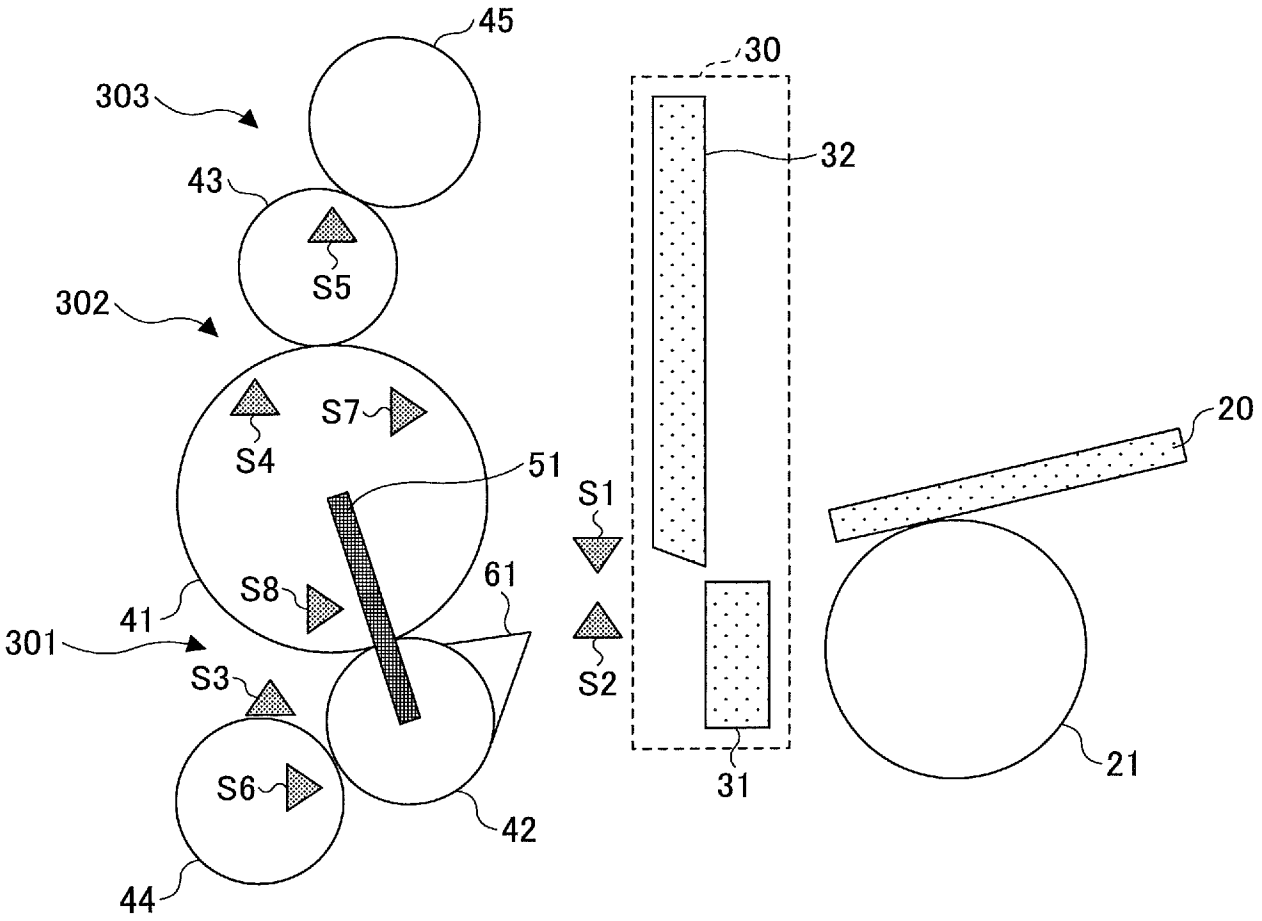
FIG. 5 is a diagram illustrating a printer of a second embodiment.
Figure 6A:
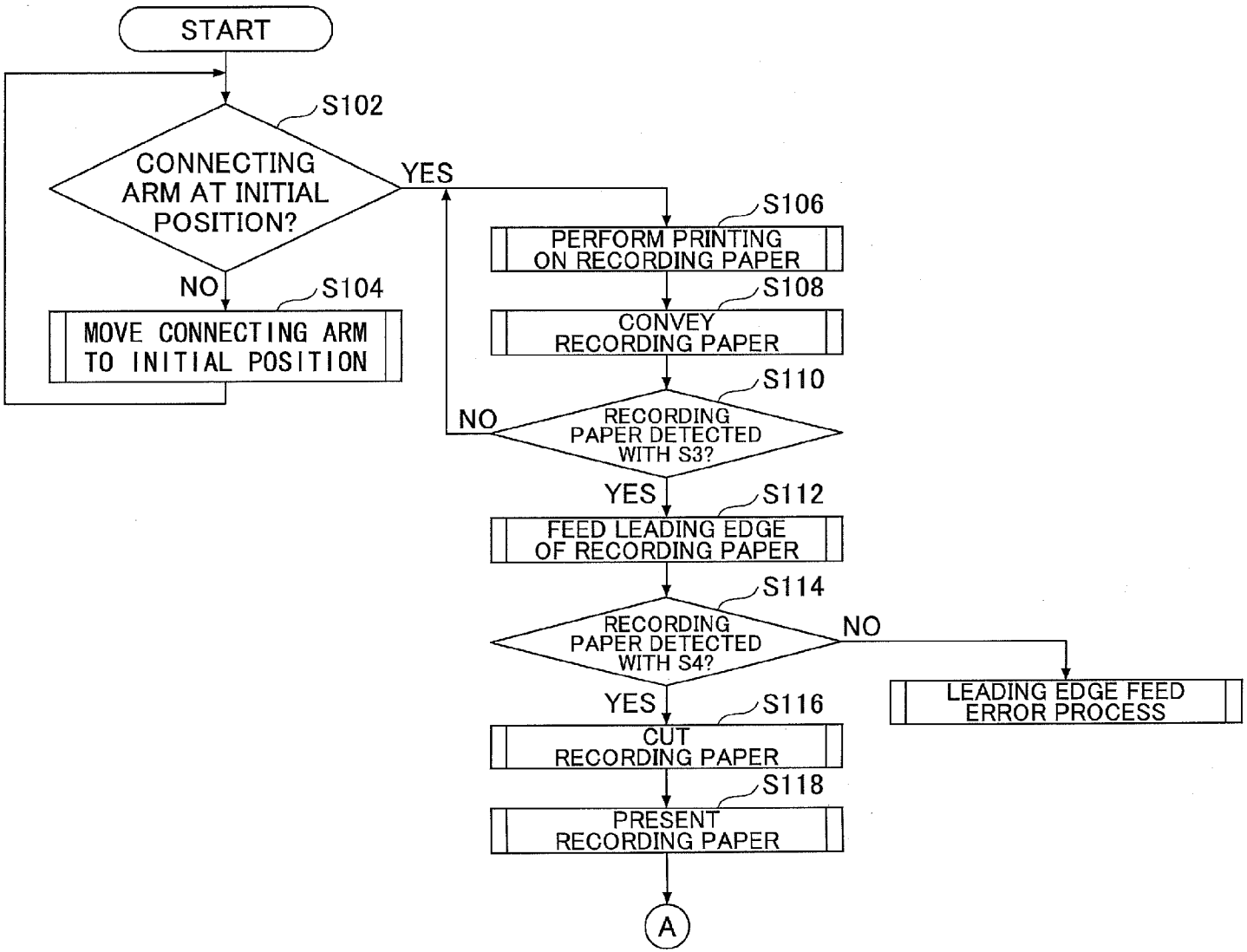
FIG. 6A is a flowchart of a method of controlling a printer of the second embodiment.
Figure 6B:
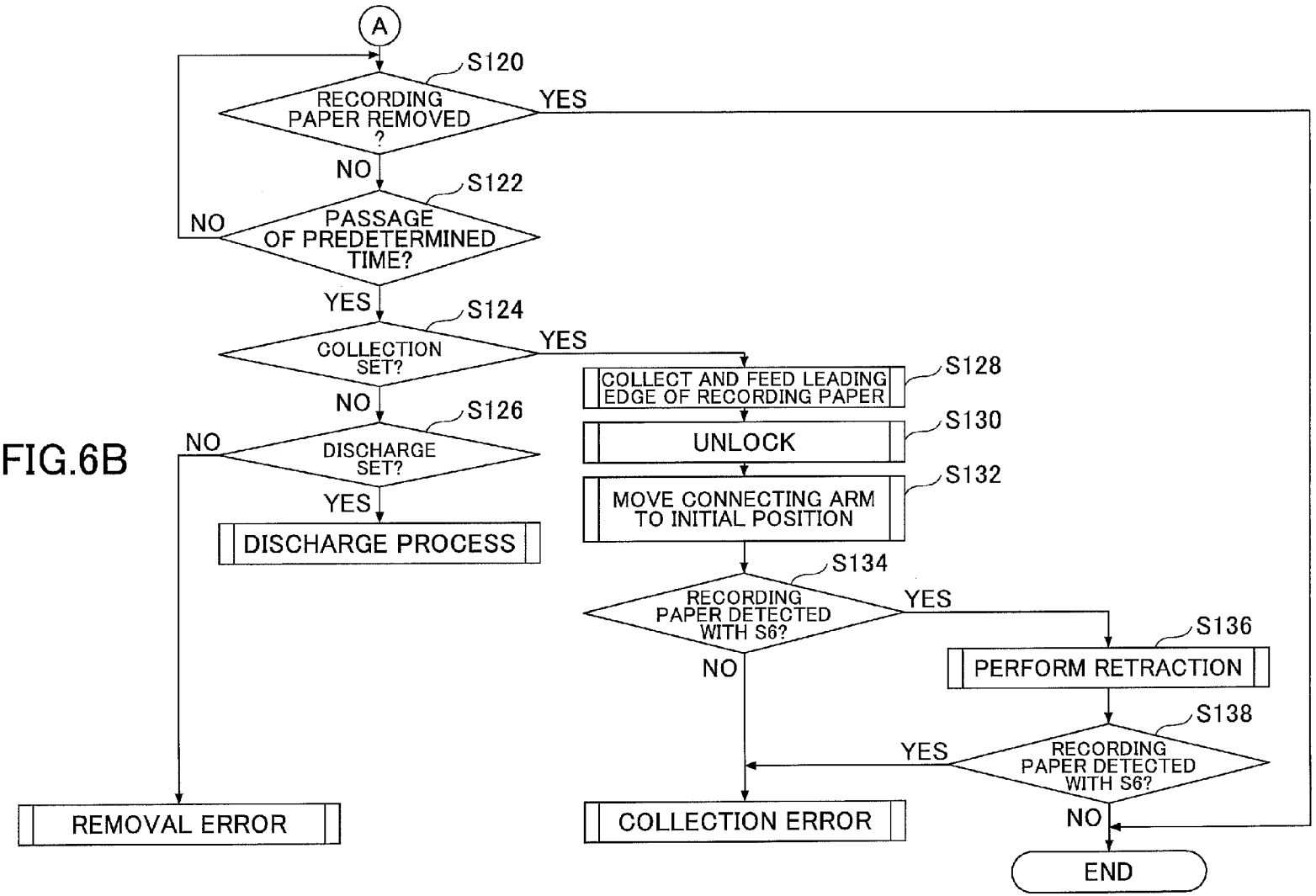
FIG. 6B is a flowchart of the method of controlling a printer of the second embodiment.

A method of controlling a printer of this embodiment is described based on FIGS. 6A and 6B. This method of controlling a printer is a control method when operating the printer as a presenter of the recording paper 10 at the second discharge opening 302. When the printer is not operated as a presenter, the recording paper 10 is discharged from the first discharge opening 301 illustrated in FIG. 5 the same as in the case illustrated in FIG. 2 in the first embodiment.

First, at step S102 of FIG. 6A, it is determined whether the connecting arm 51 is at a predetermined initial position. The connecting arm 51 is referred to as being at a predetermined initial position when, for example, the connecting arm 51 is positioned so as to cause the second roller 42 to be below the first roller 41 as illustrated in FIG. 5. Whether the connecting arm 51 is at an initial position may be determined by whether the eighth sensor S8 detects the connecting arm 51 or not. If the connecting arm 51 is detected by the eighth sensor S8 so that it is determined that the connecting arm 51 is at an initial position (YES at step S102), the process proceeds to step S106. On the other hand, if the connecting arm 51 is not detected by the eighth sensor S8 so that it is determined that the connecting arm 51 is not at an initial position (NO at step S102), the process proceeds to step S104.

Next, at step S104, the connecting arm 51 is moved to the predetermined initial position, that is, a position where the connecting arm 51 is detected by the eighth sensor S8. Specifically, the connecting arm 51 is moved to the predetermined initial position by moving the second roller 42 in contact with the outer periphery of the first roller 41 clockwise by rotating the first roller 41 clockwise. If the connecting arm 51 is not detected by the eighth sensor S8 even after repeating this process several times, an error process is executed.

On the other hand, at step S106, printing is performed on the recording paper 10. At this point, because the platen roller 21 rotates counterclockwise, the recording paper 10 is conveyed through the cutter part 30 to the side on which the first roller 41 that operates as a presenter is provided.

Next, at step S108, the recording paper 10 is conveyed while performing a predetermined amount of printing on the recording paper 10, and further, the first roller 41 is rotated clockwise. Because the platen roller 21 rotates counterclockwise, the recording paper 10 subjected to printing is conveyed, so that the recording paper 10 is held between the first roller 41 rotating clockwise and the second roller 42 rotating counterclockwise.

Next, at step S110, the presence or absence of the recording paper 10 is determined by the third sensor S3. If the recording paper 10 is detected by the third sensor S3 (sensor 72) as illustrated in FIG. 3A (YES at step S110), the process proceeds to step S112. On the other hand, if the recording paper 10 is not detected by the third sensor S3 (NO at step S110), the process proceeds to step S106.

Figure 7:
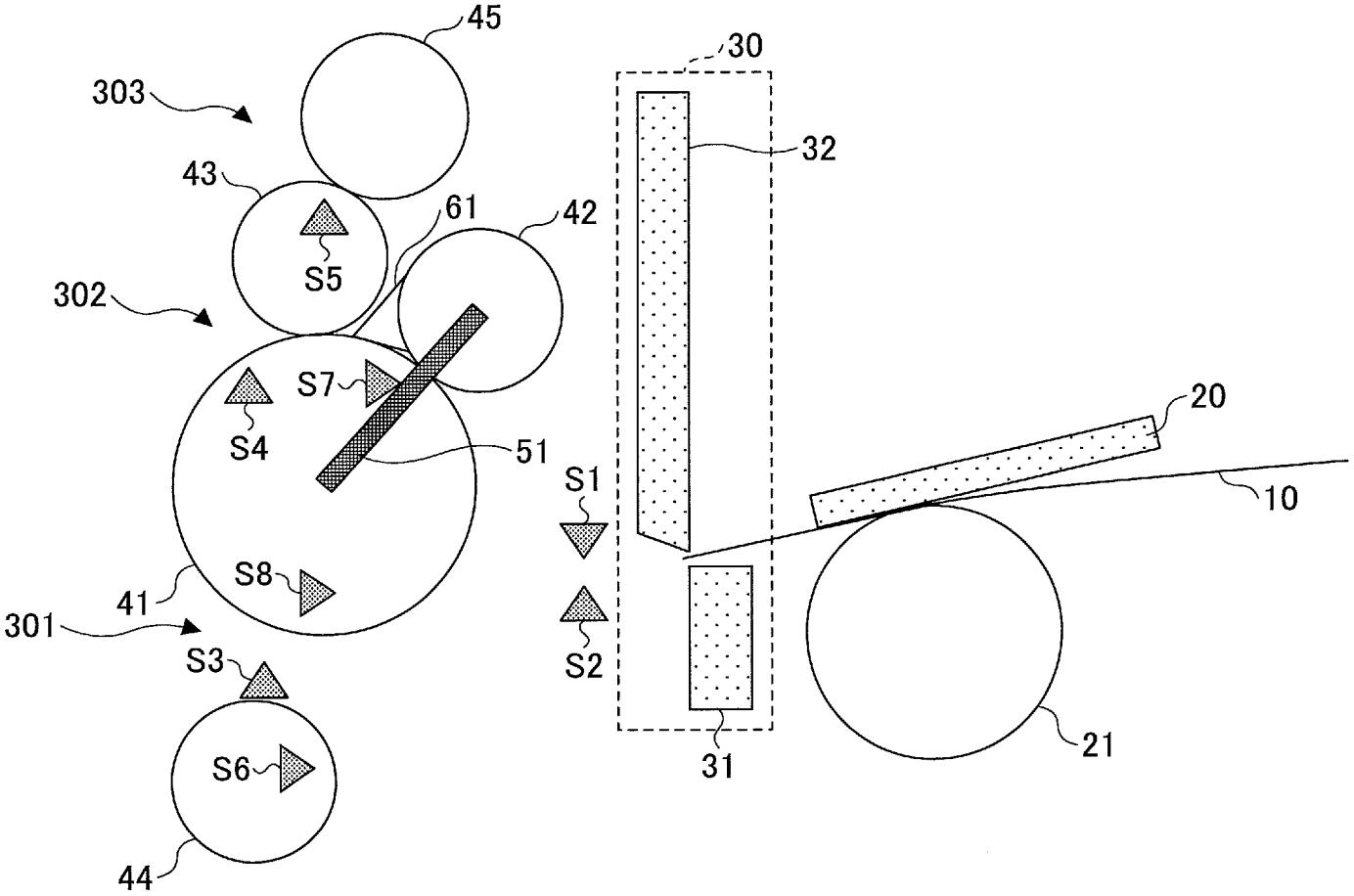
FIG. 7 is a diagram illustrating a printer of the second embodiment.

Next, at step S112, an operation to feed a leading edge of the recording paper 10 is performed. That is, by rotating the first roller 41 counterclockwise, the second roller 42 is moved counterclockwise on the outer periphery of the first roller 41. At this point, the second roller 42 moves on the outer periphery of the first roller 41 with the recording paper 10 being held between the first roller 41 and the second roller 42. As illustrated in FIG. 7, the second roller 42 moves until the second roller 42 is positioned above the first roller 41, and with this, the connecting arm 51 also moves. The position of the connecting arm 51 in this state can be detected with the seventh sensor S7. By rotating the first roller 41 counterclockwise in the state illustrated in FIG. 7, the third roller 43 rotates clockwise. As a result, it is possible to hold the recording paper 10 between the first roller 41 and the third roller 43. In this state, the thermal head 20 continues to perform printing on the recording paper 10. Specifically, it is possible to cause a transition from the state illustrated in FIG. 3B to the state illustrated in FIG. 3C.

Next, at step S114, the presence or absence of the recording paper 10 is determined by the fourth sensor S4. If the recording paper 10 is detected by the fourth sensor S4 (YES at step S114), the process proceeds to step S116. On the other hand, if the recording paper 10 is not detected by the fourth sensor S4 (NO at step S114), it is determined as a leading edge feed error, and a leading edge feed error process is executed.

Next, at step S116, printing on the recording paper 10 by the thermal head 20 is stopped, and the recording paper 10 is cut to a predetermined length in the cutter part 30. Specifically, the recording paper 10 is cut to a predetermined length after the recording paper enters the state illustrated in FIG. 3D.

Next, at step S118, the recording paper 10 is presented. Specifically, the recording paper 10 subjected to printing is conveyed to a predetermined position at the second discharge opening 302 with the first roller 41 and the third roller 43 by rotating the third roller 43 clockwise by rotating the first roller 41 counterclockwise. Specifically, the recording paper 10 is conveyed to the predetermined position as illustrated in FIG. 3E.

Next, at step S120 of FIG. 6B, it is determined whether the recording paper 10 subjected to printing at the second discharge opening 302 is removed. If the recording paper 10 is removed (YES at step S120), the process of FIG. 6B ends. On the other hand, if the recording paper 10 is not removed (NO at step S120), the process proceeds to step S122. Whether the recording paper 10 is removed may be determined by whether the recording paper 10 is detected at the fourth sensor S4.

Next, at step S122, it is determined whether a predetermined time has passed. If it is determined that a predetermined time has passed (YES at step S122), the process proceeds to step S124. On the other hand, if it is determined that a predetermined time has not passed (NO at step S122), the process proceeds to step S120.

Next, at step S124, it is determined whether a collection of the recording paper 10 is set or not. Specifically, it is determined whether a flag indicating that the recording paper 10 subjected to printing is to be collected if the recording paper 10 is not removed within a predetermined time is set or not at initial settings. If a flag indicating that the recording paper 10 subjected to printing is to be collected is on (YES at step S124), it is determined that the collection of the recording paper 10 is set, and the process proceeds to step S128. On the other hand, if no flag indicating that the recording paper 10 subjected to printing is to be collected is on (NO at step S124), it is determined that the collection of the recording paper 10 is not set, and the process proceeds to step S126.

Next, at step S126, it is determined whether a discharge of the recording paper 10 is set or not. Specifically, it is determined whether a flag indicating that the recording paper 10 subjected to printing is to be discharged if the recording paper 10 is not removed within a predetermined time is set or not at the initial settings. If a flag indicating that the recording paper 10 subjected to printing is to be discharged is on (YES at step S126), it is determined that the discharge of the recording paper 10 is set, and a discharge process to discharge the recording paper 10 subjected to printing is executed. On the other hand, if no flag indicating that the recording paper 10 subjected to printing is to be discharged is on (NO at step S126), it is determined that the discharge of the recording paper 10 is not set, thus resulting in a removal error, so that an error display is performed.

On the other hand, at step S128, the first roller 41 is rotated clockwise from the state illustrated in FIG. 3E where the connecting arm 51 is locked. By thus rotating the first roller 41 clockwise with the connecting arm 51 being locked, the second roller 42 rotates counterclockwise, so that it is possible to cause the recording paper 10 held between the first roller 41 and the third roller 43 to be held between the first roller 41 and the second roller 42. Specifically, the recording paper 10 can be held between the first roller 41 and the second roller 42 as illustrated in FIG. 3F. The state where the connecting arm 51 is thus locked by the lock part 52 is maintained until the recording paper 10 held between the first roller 41 and the third roller 43 is held between the first roller 41 and the second roller 42.

Next, at step S130, the connecting arm 51 is unlocked. As a result, the connecting arm 51 can move, so that the second roller 42 can move on the outer periphery of the first roller 41.

Next, at step S132, an operation to move the connecting arm 51 to a predetermined position is performed. That is, by rotating the first roller 41 clockwise, the second roller 42 is moved clockwise on the outer periphery of the first roller 41. At this point, the second roller 42 moves clockwise on the outer periphery of the first roller 41 with the recording paper 10 being held between the first roller 41 and the second roller 42. As a result, it is possible to move the second roller 42 to a predetermined initial position. It is possible to detect the position of the connecting arm 51 after the movement with the eighth sensor S8. Specifically, the second roller 42 is moved to the predetermined initial position as illustrated in FIG. 3G. At this point, the second roller 42 is in contact with the fourth roller 44.

Next, at step S134, it is determined whether the recording paper 10 is detected at the sixth sensor S6. If the recording paper 10 is detected by the sixth sensor S6 (YES at step S134), it is possible to perform a retracting operation, so that the process proceeds to step S136. On the other hand, if the recording paper 10 is not detected by the sixth sensor S6 (NO at step S134), it is determined as a collection error, and an error display is performed.

Next, at step S136, retraction is performed. That is, as illustrated in FIG. 3G, with a clockwise rotation of the first roller 41, the second roller 42 rotates counterclockwise and the fourth roller 44 rotates clockwise, so that the recording paper 10 subjected to printing is held between the second roller 42 and the fourth roller 44, and the recording paper 10 is thereafter conveyed to the retractor box 81 from between the first roller 41 and the second roller 42 through the second roller 42 and the fourth roller 44. At this point, the recording paper 10 is detected by the sixth sensor S6.

Next, at step S138, it is determined whether the retracting operation has ended. Specifically, if the sixth sensor S6 continues to detect the recording paper 10 (YES at step S138), it is determined as a collection error, and an error display is performed. On the other hand, if the recording paper 10 is no longer detected by the sixth sensor S6 (NO at step S138), it is determined that the retracting operation has normally ended, and the method of controlling a printer according this embodiment ends.

Third Embodiment

Next, a third embodiment is described. A printer according to this embodiment is the same printer as in the first embodiment, and performs printing on a label with an adhesive substance such as glue adhering to its bottom surface. Printing is performed on such a label with the label being applied to a liner because of adhesion of an adhesive substance such as glue to the bottom surface of the label. According to the printer of this embodiment, it is possible to switch between printing on normal recording paper and printing on a label using a switch provided in the printer. Furthermore, the printer of this embodiment is provided with an assist roller 143 that rotates in contact with the third roller 43.

The case of discharging a label 110 subjected to printing in the printer of this embodiment is described based on FIGS. 8A through 8G. In the initial state, the label 110 is applied to a liner 111.

Figure 8A:
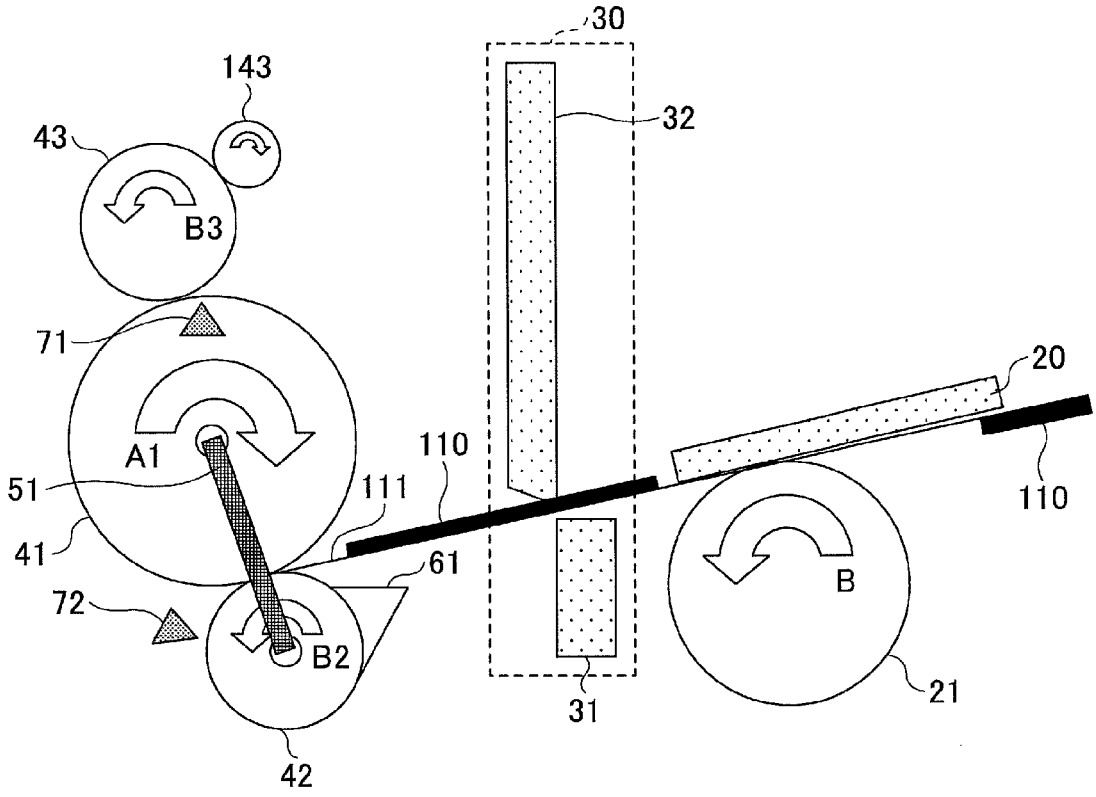
FIG. 8A is a diagram illustrating a method of discharging a label of a printer of a third embodiment.

First, as illustrated in FIG. 8A, printing is performed on the label 110 applied to the liner 111 by the thermal head 20. At this point, the platen roller 21 rotates counterclockwise as indicated by arrow B, so that the liner 111 to which the label 110 is applied is conveyed through the cutter part 30 to the side on which the first roller 41 is provided. The second roller 42 is provided with the recording paper guide 61, and the liner 111 to which the label 110 is applied is conveyed along the recording paper guide 61 so as to enter between the first roller 41 and the second roller 42. That is, by rotating the first roller 41 clockwise as indicated by arrow A1, the second roller 42 rotates counterclockwise as indicated by arrow B2, so that it is possible to hold an end portion of the liner 111 to which the label 110 is applied by the first roller 41 and the second roller 42. At this point, the second roller 42 is rotating at the position illustrated in FIG. 8A by coming into contact with the fourth roller 44 not illustrated in the drawing or by the connecting arm 51 being formed so as to prevent its position from rotating clockwise from the state illustrated in FIG. 8A.

Figure 8B:
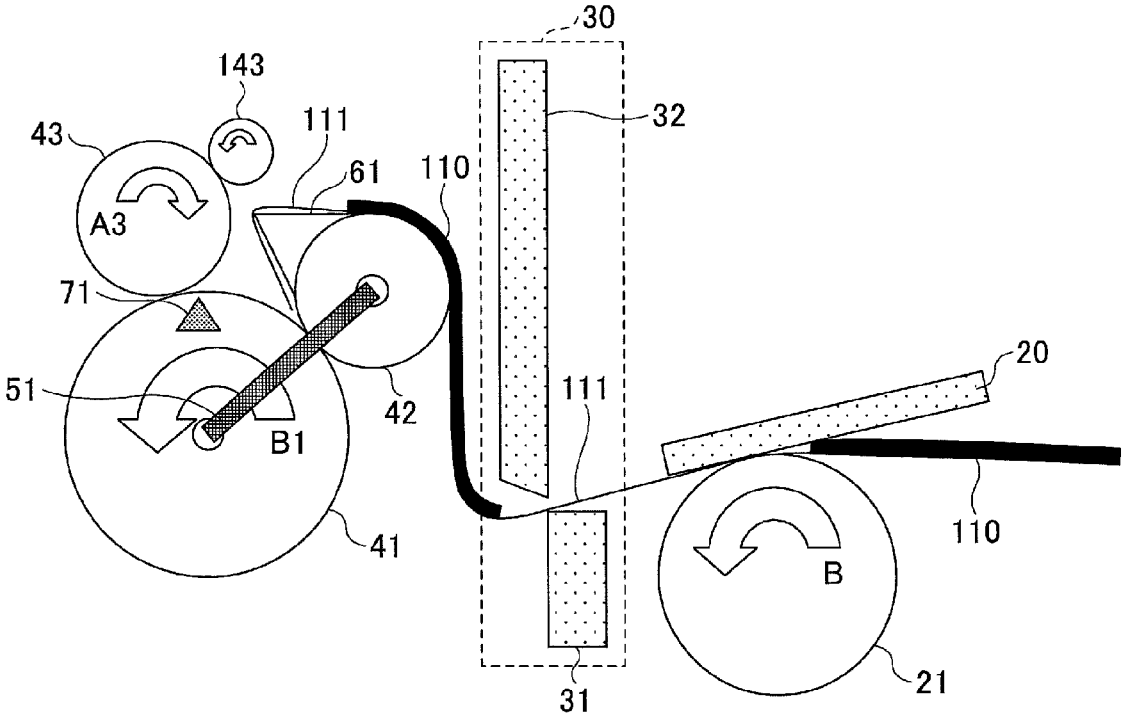
FIG. 8B is a diagram illustrating the method of discharging a label of a printer of the third embodiment.

Next, as illustrated in FIG. 8B, the first roller 41 is rotated counterclockwise as indicated by arrow B1. As a result, the second roller 42, whose center is connected to the center of the first roller 41 by the connecting arm 51, moves counterclockwise on the outer periphery of the first roller 41 with an end portion of the liner 111 to which the label 110 is applied being held between the first roller 41 and the second roller 42. Specifically, the second roller 42 moves to the vicinity of the third roller 43, so that the recording paper guide 61 and the third roller 43 are out of contact.

Figure 8C:
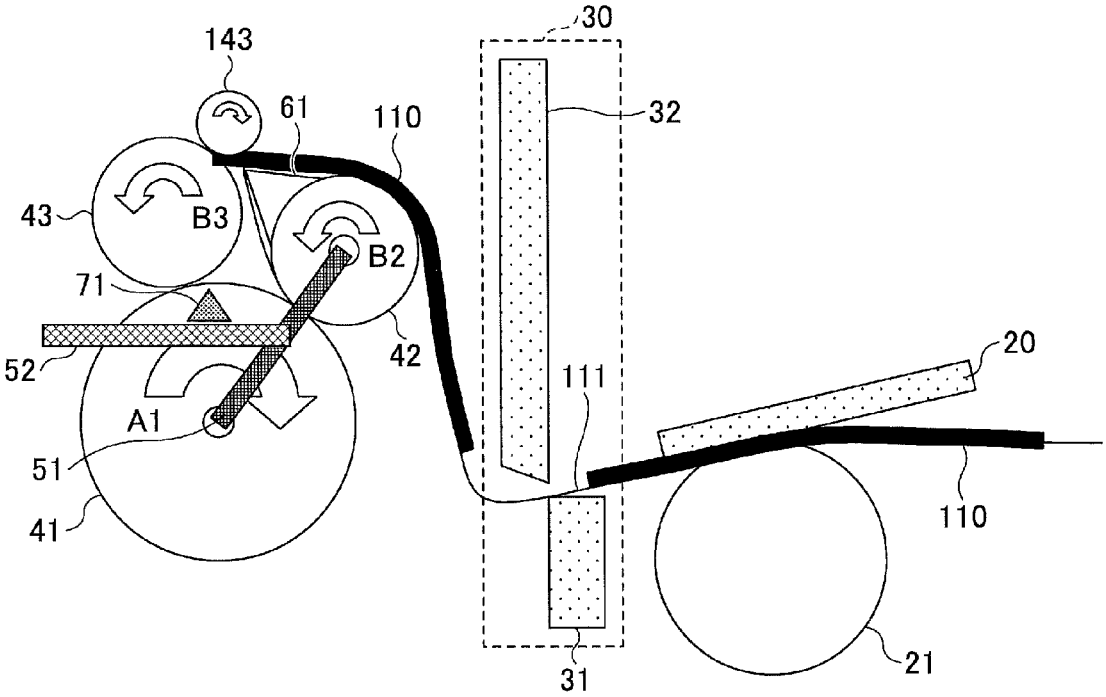
FIG. 8C is a diagram illustrating the method of discharging a label of a printer of the third embodiment.

Next, as illustrated in FIG. 8C, the connecting arm 51 is fixed by the lock part 52, and the first roller 41 is rotated clockwise as indicated by arrow A1. By rotating the first roller 41 clockwise as indicated by arrow A1, the second roller 42 rotates counterclockwise as indicated by arrow B2 and the third roller 43 rotates counterclockwise as indicated by arrow B3. At this point, the label 110 subjected to printing is removed from the liner 111 by the recording paper guide 61, and the label 110 is held between the third roller 43 and the assist roller 143. On the other hand, the liner 111 passes between the second roller 42 and the third roller 43 via the recording paper guide 61 and is thereafter held between the first roller 41 and the second roller 42. Thereafter, the liner 111 to which the label 110 is applied is cut to a predetermined length in the cutter part 30. The assist roller 143 rotates in a direction opposite to the rotation direction of the third roller 43, and in this case, rotates clockwise.

Figure 8D:
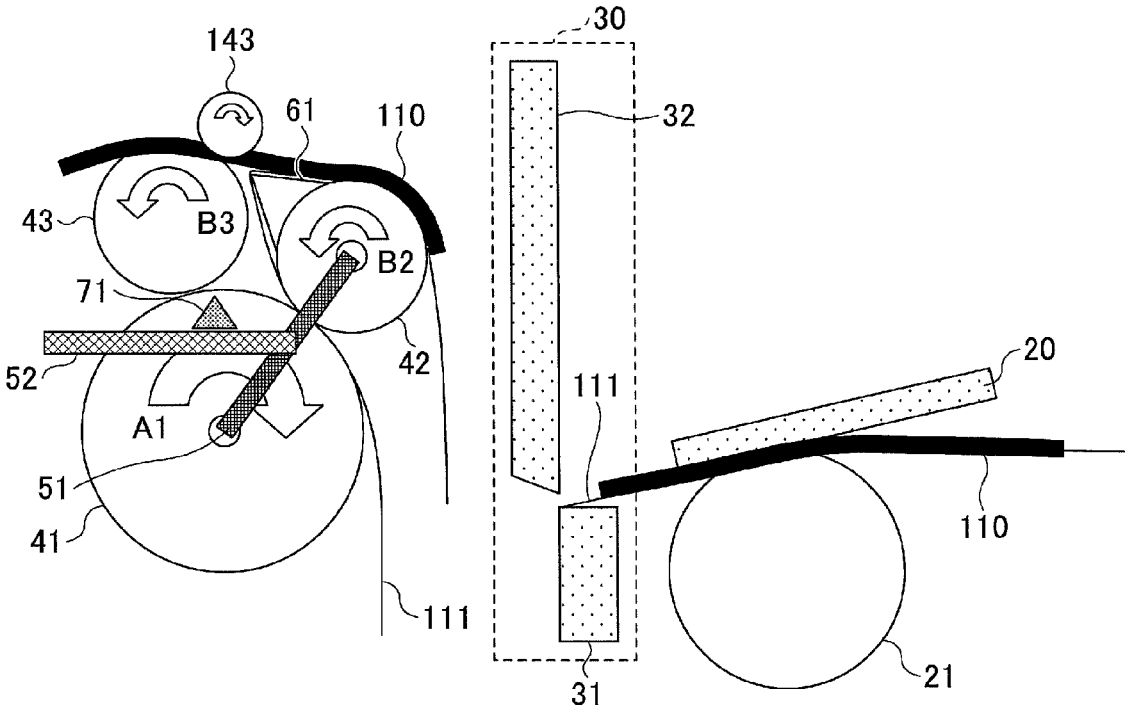
FIG. 8D is a diagram illustrating the method of discharging a label of a printer of the third embodiment.

Next, as illustrated in FIG. 8D, by further rotating the first roller 41 clockwise as indicated by arrow A1, while removing the label 110 from the liner 111, the label 110 is conveyed with the third roller 43 and the assist roller 143, and the liner 111 is conveyed with the first roller 41 and the second roller 42.

Figure 8E:
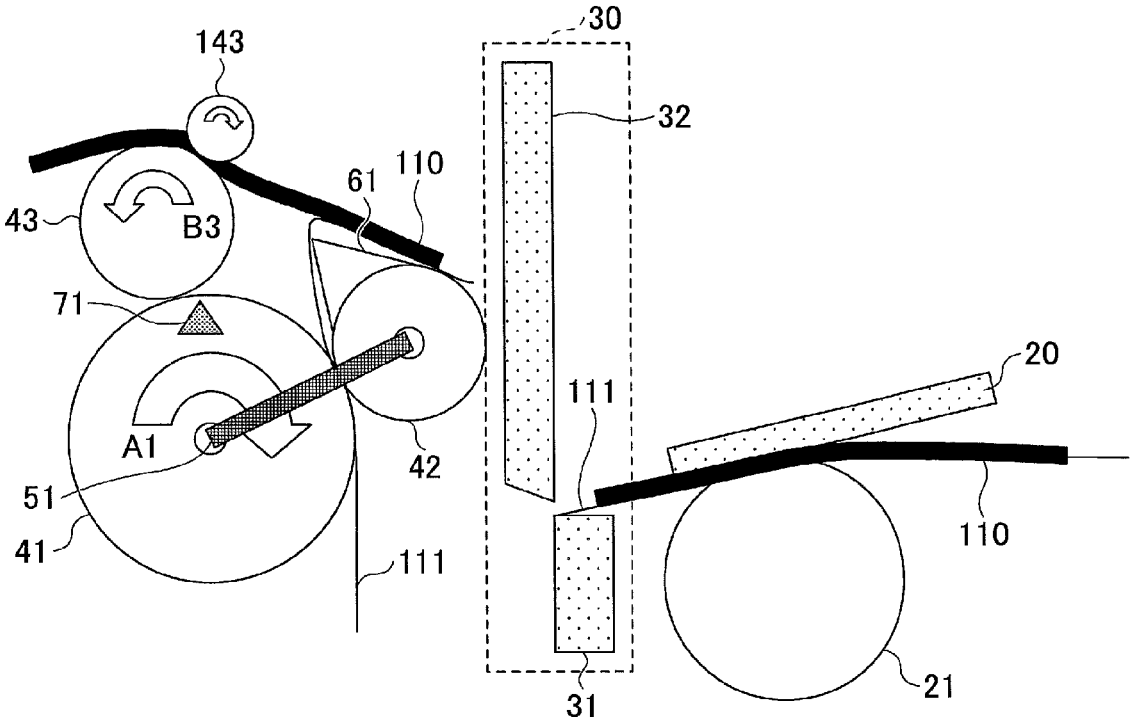
FIG. 8E is a diagram illustrating the method of discharging a label of a printer of the third embodiment.

Next, as illustrated in FIG. 8E, the connecting arm 51 locked by the lock part 52 is released with the first roller 41 being kept rotating clockwise as indicated by arrow A1. As a result, the second roller 42 moves clockwise on the outer periphery of the first roller 41. At this point, the second roller 42 moves while removing the label 110 from the liner 111. The label 110 removed from the liner 111 is conveyed in a direction to discharge the label 111 with the third roller 43 and the assist roller 143.

Figure 8F:
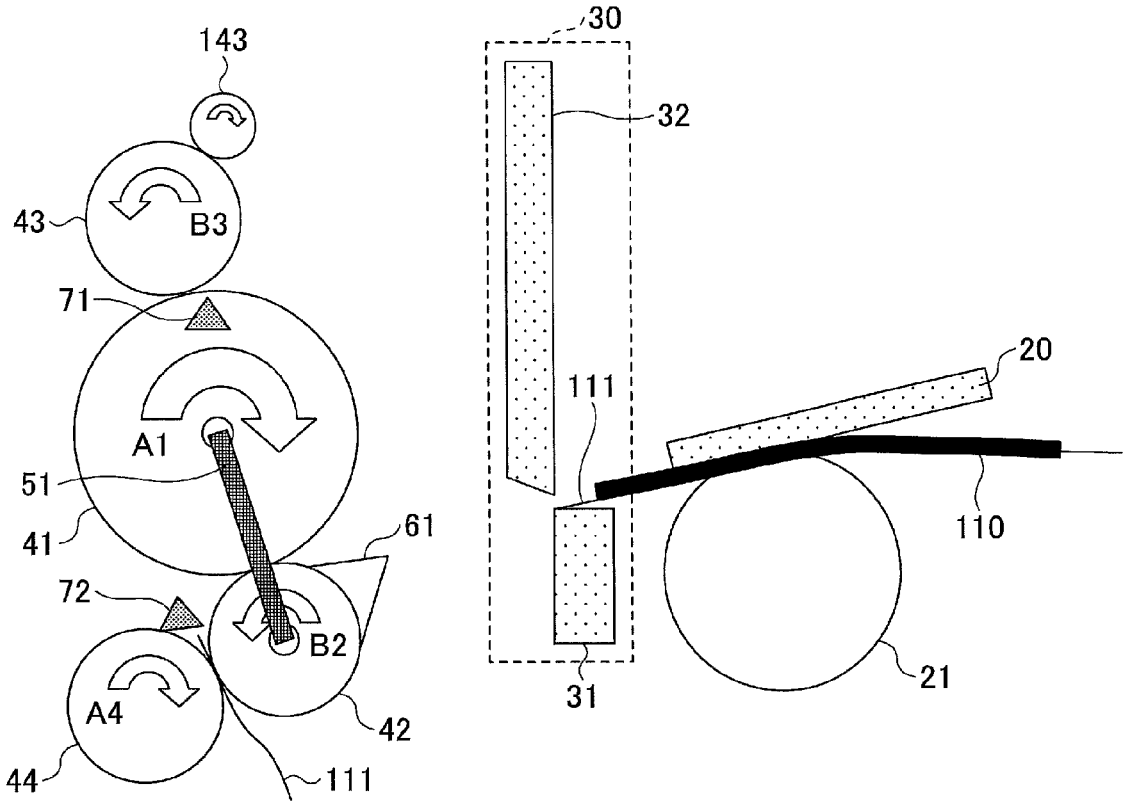
FIG. 8F is a diagram illustrating the method of discharging a label of a printer of the third embodiment.
Figure 8G:
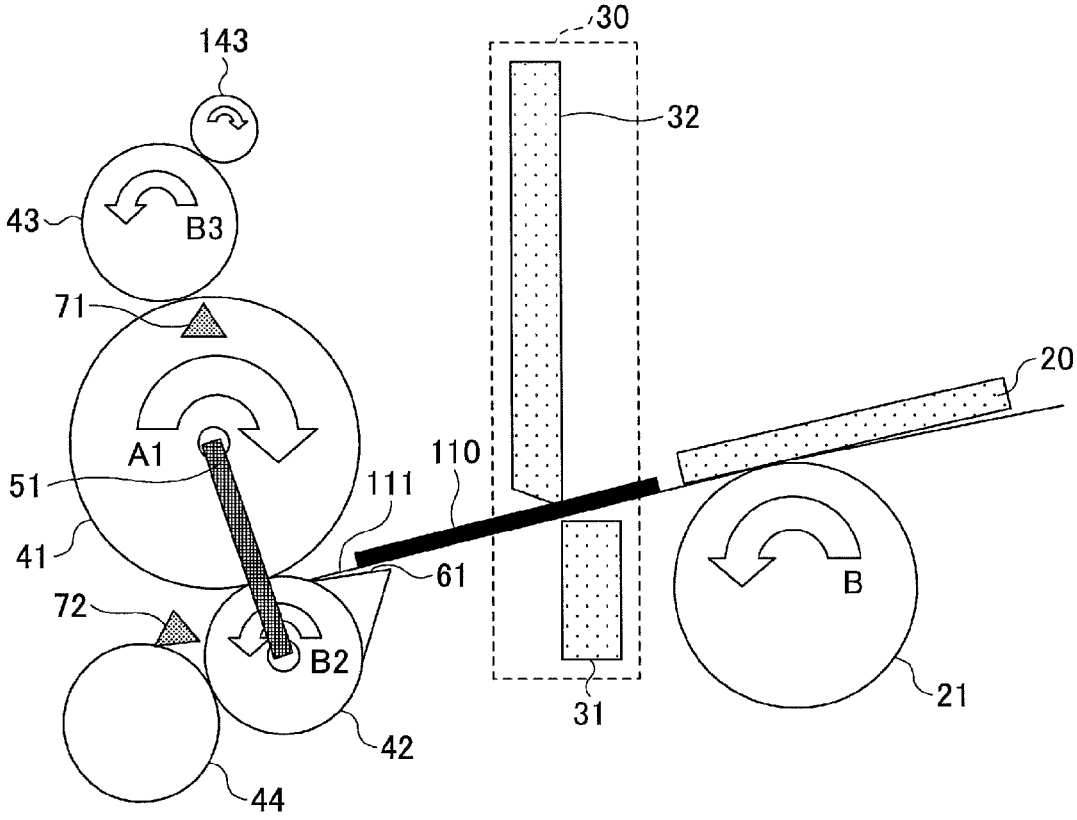
FIG. 8G is a diagram illustrating the method of discharging a label of a printer of the third embodiment.

Next, as illustrated in FIG. 8F, by further rotating the first roller 41 clockwise as indicated by arrow A1, the second roller 42 and the fourth roller 44 are brought into contact. As a result, the liner 111 is held between the second roller 42 and the fourth roller 44. By further rotating the first roller 41 clockwise as indicated by arrow A1 in this state, the second roller 42 rotates counterclockwise as indicated by arrow B2, so that the fourth roller 44, which rotates by contacting the second roller 42, rotates clockwise as indicated by arrow A4. Thus, the liner 111 is conveyed and discharged with the second roller 42 and the fourth roller 44.

Thereafter, as illustrated in FIG. 8G, printing is again performed on the next label 110 by the thermal head 20, and the liner 111 to which the next label 110 is applied is conveyed through the cutter part 30 to the side on which the first roller 41 is provided by the platen roller 21 rotating counterclockwise as indicated by arrow B. Thereafter, like in the above-described case, the liner 111 to which the label 110 is applied is held between the first roller 41 and the second roller 42, and the same operation as the above-described operation is repeated.

In this embodiment, it is possible to remove the label 110 subjected to printing from the liner 111 and feed the label 110 with the first roller 41, the second roller 42, the third roller 43, the fourth roller 44, and the assist roller 143. Therefore, it is possible to reduce the size of a printer capable of perform printing on the label 110.

Furthermore, in the case of combining this embodiment with the first embodiment, the normal recording paper 10 is discharged between the first roller 41 and the third roller 43, and the label 110 is discharged between the third roller 43 and the assist roller 143. Accordingly, it is possible to discharge the recording paper 10 and the label 110 from different positions.

The configuration other than that described above is the same as in the first embodiment.

Fourth Embodiment

Next, a fourth embodiment is described. This embodiment relates to a method of controlling a printer of the third embodiment. A printer structure for describing the method of controlling a printer of this embodiment is the same as the structure described in FIG. 5 in the second embodiment. In this embodiment, the fifth roller 45 has the same function as the assist roller 143 of the third embodiment. The operation of the assist roller 143 is described below as the operation of the fifth roller 45.

Figure 9:
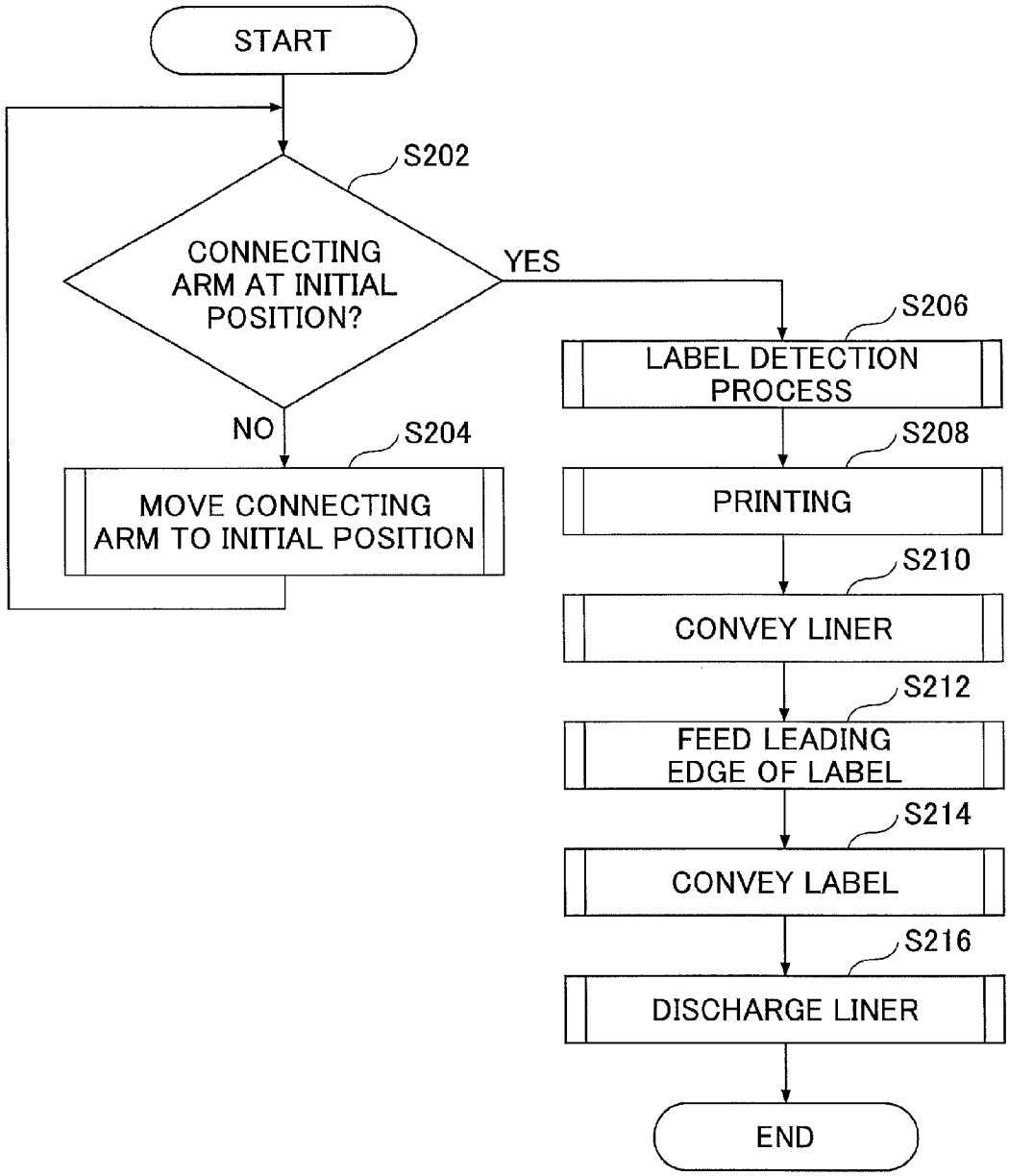
FIG. 9 is a flowchart of a method of controlling a printer of a fourth embodiment.

The method of controlling a printer of this embodiment is described based on FIG. 9.

First, at step S202, it is determined whether the connecting arm 51 is at a predetermined initial position. The connecting arm 51 is referred to as being at a predetermined initial position when, for example, the connecting arm 51 is positioned so as to cause the second roller 42 to be below the first roller 41 as illustrated in FIG. 5. Whether the connecting arm 51 is at an initial position may be determined by whether the eighth sensor S8 detects the connecting arm 51 or not. If the connecting arm 51 is detected by the eighth sensor S8 so that it is determined that the connecting arm 51 is at an initial position (YES at step S202), the process proceeds to step S206. On the other hand, if the connecting arm 51 is not detected by the eighth sensor S8 so that it is determined that the connecting arm 51 is not at an initial position (NO at step S202), the process proceeds to step S204.

Next, at step S204, the connecting arm 51 is moved to the predetermined initial position, that is, a position where the connecting arm 51 is detected by the eighth sensor S8. Specifically, the connecting arm 51 is moved to the predetermined initial position by moving the second roller 42 in contact with the outer periphery of the first roller 41 clockwise by rotating the first roller 41 clockwise. If the connecting arm 51 is not detected by the eighth sensor S8 even after repeating this process several times, an error process is executed.

At step S206, a label detection process is executed. Specifically, the label 110 applied to the liner 111 differs in light reflectance or transmittance between a part of the liner 111 and a part of the label 110. Accordingly, it is possible to detect the position of the liner 111 and a position at which the label 110 is applied on the liner 111 with the first sensor S1 and the second sensor S2.

Next, at step S208, printing is performed on the label 110. At this point, because the platen roller 21 rotates counterclockwise, the liner 111 to which the label 110 is applied is conveyed through the cutter part 30 in a direction in which the first roller 41 is provided.

Next, at step S210, the liner 111 is further conveyed while performing printing on the label 110, and the first roller 41 is rotated clockwise. That is, because the platen roller 21 rotates counterclockwise, the liner 111 to which the label 110 subjected to printing is applied is conveyed and the liner 111 is held between the first roller 41 rotating clockwise and the second roller 42 rotating counterclockwise. Specifically, the liner 111 is held between the first roller 41 and the second roller 42 as illustrated in FIG. 8A.

Next, at step S212, an operation to feed a leading edge of the label 110 is performed. That is, by rotating the first roller 41 counterclockwise, the second roller 42 is moved counterclockwise on the outer periphery of the first roller 41. At this point, the second roller 42 moves on the outer periphery of the first roller 41 with the liner 111 being held between the first roller 41 and the second roller 42. As illustrated in FIG. 7, the second roller 42 moves until the second roller 42 is positioned above the first roller 41, and with this, the connecting arm 51 also moves. Therefore, it is possible to detect the position of the connecting arm 51 in this state with the seventh sensor S7. Specifically, the second roller 42 and the connecting arm 51 are moved as illustrated in FIG. 8B. In this state, by rotating the first roller 41 clockwise, the second roller 42 rotates counterclockwise. Therefore, it is possible to hold the liner 111 between the first roller 41 and the second roller 42.

Next, at step S214, the connecting arm 51 is fixed by the lock part 52, and the first roller 41 is rotated clockwise. As a result, the second roller 42 rotates counterclockwise, and the third roller 43 rotates counterclockwise. Furthermore, the fifth roller 45 in contact with the third roller 43 rotates clockwise. As a result, the label 110 is removed from the liner 111, and the label 110 is conveyed toward the third discharge opening 303 with the third roller 43 and the fifth roller 45. The liner 111 is held between the first roller 41 and the second roller 42 and is conveyed as is with the first roller 41 and the second roller 42. Specifically, the liner 111 is conveyed as illustrated in FIGS. 8C and 8D. The liner 111 is cut to a predetermined length in the cutter part 30.

Next, at step S216, the liner 111 is discharged. Specifically, the connecting arm 51 fixed by the lock part 52 is released with the first roller 41 being kept rotating clockwise. As a result, the second roller 42 moves clockwise on the outer periphery of the first roller 41, and moves to the predetermined initial position illustrated in FIG. 5. Thereafter, by further rotating the first roller 41 clockwise, the liner 111 is discharged by the first roller 41 and the second roller 42. Specifically, the liner 111 is discharged as illustrated in FIGS. 8E and 8F.

Thereby, processing such as printing on a label in a printer of this embodiment ends. The configuration other than that described above is the same as in the second embodiment.

Fifth Embodiment

Next, a printer of a fifth embodiment is described.

[Printer Structure]

Figure 10:
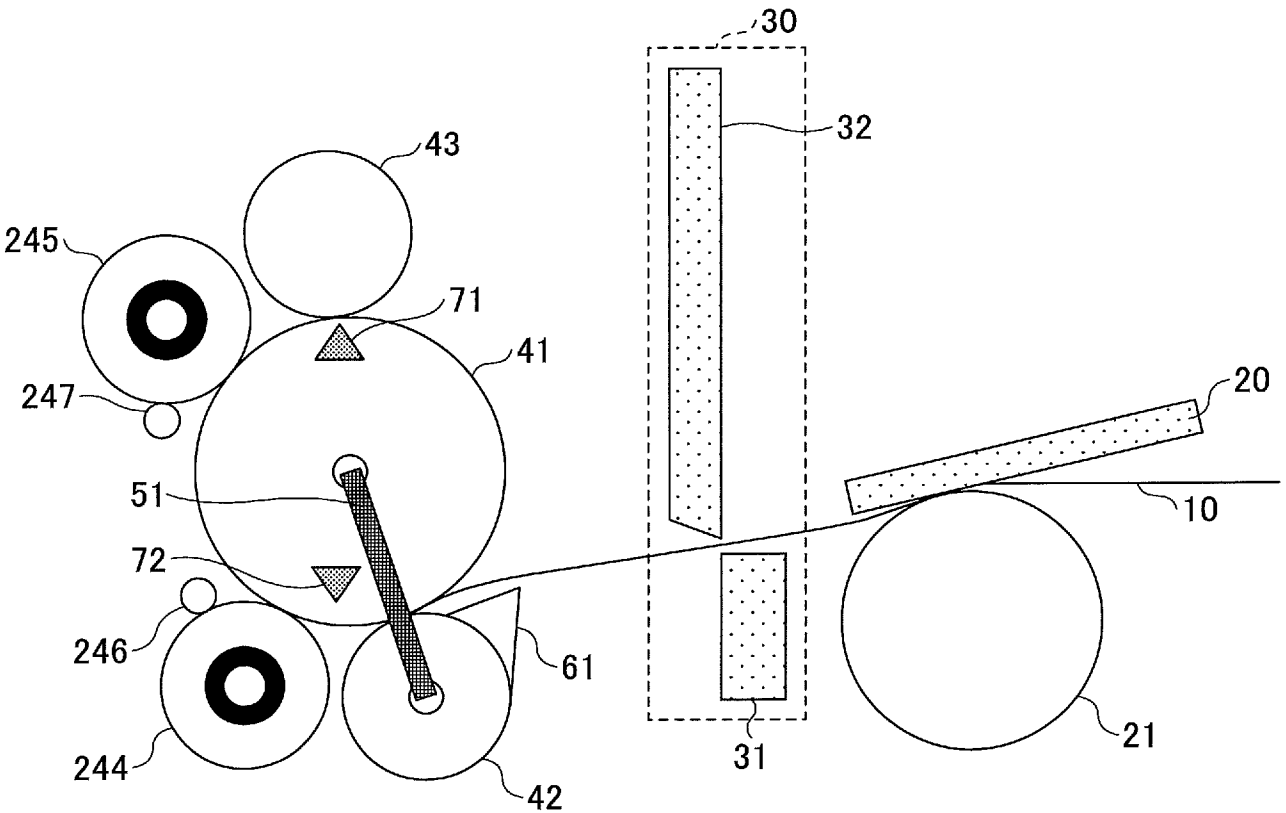
FIG. 10 is a structural diagram of a printer of a fifth embodiment.

First, a printer structure of this embodiment is described based on FIG. 10. A printer of this embodiment includes the thermal head 20 that prints characters on the recording paper 10 wound in a roll and the cutter part 30 that cuts the recording paper 10 subjected to printing in the thermal head 20 to a predetermined length. The recording paper 10 is thermal paper, and is subjected to printing by the thermal head 20 with the recording paper 10 being held between the thermal head 20 and the platen roller 21. The cutter part 30 includes the fixed blade 31 and the movable blade 32. The movable blade 32 moves relative to the fixed blade 31, so that it is possible to cut the recording paper 10 to a predetermined length.

In the printer of this embodiment, the first roller 41, the second roller 42, the third roller 43, a fourth roller 244, and a fifth roller 255 for discharging the recording paper 10 subjected to printing are provided outside the cutter part 30. The first roller 41 may be rotated by a drive part that is not illustrated in the drawing. The second roller 42 is in contact with the first roller 41, and is rotated by the rotation of the first roller 41. The third roller 43 is in contact with the first roller 41, and is rotated by the rotation of the first roller 41. The center of the second roller 42 and the center of the first roller 41 are connected to one end and the other end of the connecting arm 51, respectively, and it is possible for the second roller 42 to move on the outer periphery of the first roller 41.

The fourth roller 244 is a clutch roller that rotates only in a single direction, for example, the other rotation direction, and rotates in contact with the first roller 41. The fifth roller 245 is a clutch roller that rotates only in a single direction opposite to the single direction in which the fourth roller 244 rotates, for example, the one rotation direction, and rotates in contact with the first roller 41. Furthermore, the printer of this embodiment includes a first assist roller 246 that rotates by contacting the fourth roller 244, and a second assist roller 247 that rotates by contacting the fifth roller 245.

Furthermore, the second roller 42 is provided with the recording paper guide 61 in order to make it possible to smoothly guide the recording paper 10 to the second roller 42. Furthermore, in the printer of this embodiment, sensors 71 and 72 for detecting the presence or absence of the recording paper 10 are provided at predetermined positions.

The printer of this embodiment implements functions as a presenter and a retractor with the first roller 41, the second roller 42, the third roller 43, the fourth roller 244, the fifth roller 245, the first assist roller 246, the second assist roller 247, the connecting arm 51, the recording paper guide 61, and the sensors 71 and 72.

[Printer Operations]

Next, printer operations of this embodiment are described based on FIGS. 11A through 11K. In this embodiment, the one rotation direction is described as a clockwise direction, and the other rotation direction is described as a counterclockwise direction. In the following description, the recording paper 10 cut in the cutter part 30 and discharged from a first side (a first discharge opening 401) is denoted by reference numeral 10*a*, and the recording paper 10 cut in the cutter part 30 and discharged from a second side (a second discharge opening 402) is denoted by reference numeral 10*b* for convenience of description.

Figure 11A:
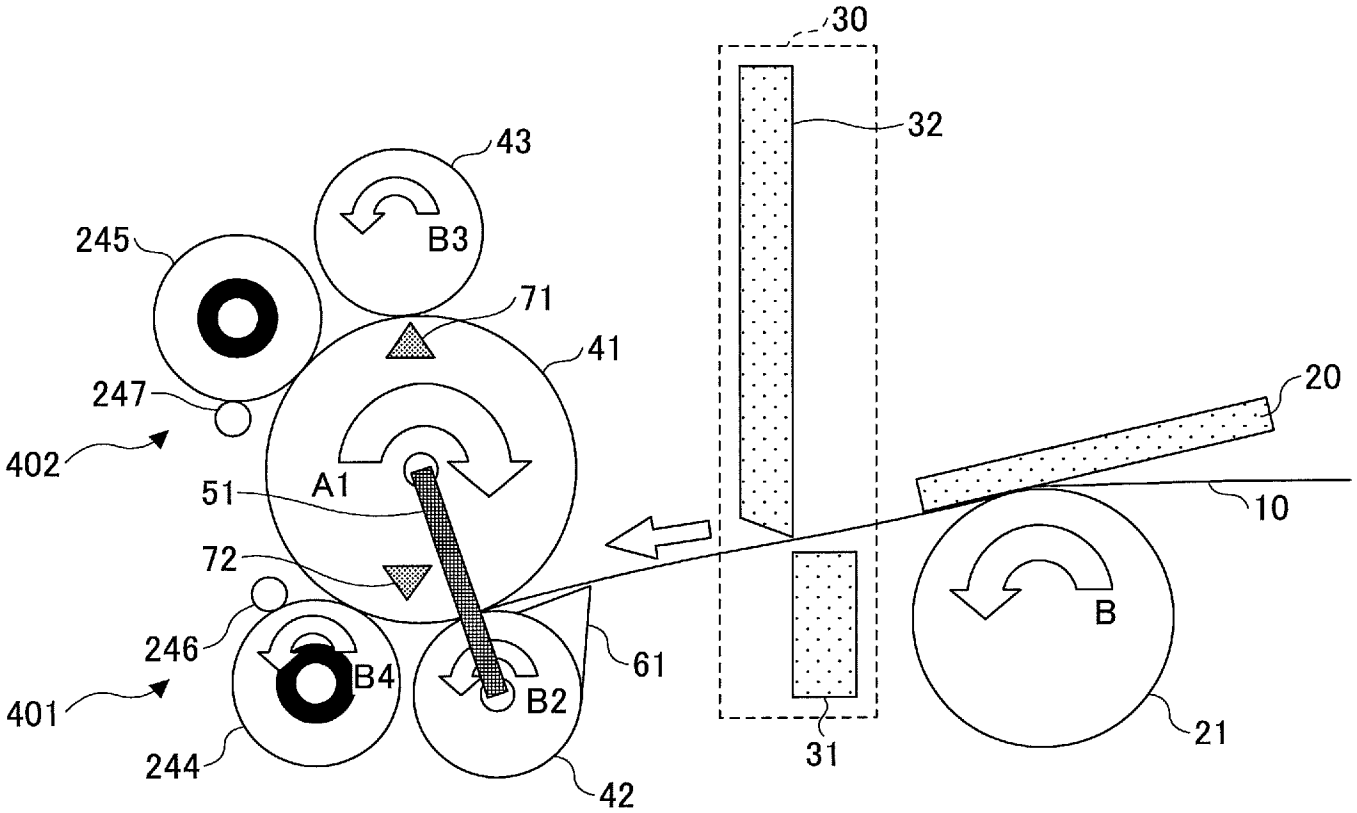
FIG. 11A is a diagram illustrating a method of discharging recording paper of a printer of the fifth embodiment.

First, as illustrated in FIG. 11A, printing is performed on the recording paper 10 that is discharged from the first side (the first discharge opening 401). Specifically, when printing is performed on the recording paper 10 by the thermal head 20, the platen roller 21 rotates counterclockwise as indicated by arrow B, so that the recording paper 10 is conveyed through the cutter part 30 to the side on which the first roller 41 is provided. The second roller 42 is provided with the recording paper guide 61, and the recording paper 10 is conveyed along the recording paper guide 61 so as to enter between the first roller 41 and the second roller 42. That is, by rotating the first roller 41 clockwise as indicated by arrow A1, the second roller 42 rotates counterclockwise as indicated by arrow B2, so that it is possible to hold the recording paper 10 between the first roller 41 and the second roller 42. At this point, the third roller 43 rotates counterclockwise as indicated by arrow B3, and the fourth roller 244 rotates counterclockwise as indicated by arrow B4 in contact with the first roller 41. Furthermore, at this point, the second roller 42, which is so formed as to make no clockwise movement from the state illustrated in FIG. 11A near the fourth roller 244, is rotating at the position illustrated in FIG. 11A. In this embodiment, as described above, the fourth roller 244 is a clutch roller that does not rotate clockwise and rotates only counterclockwise as indicated by arrow B4, that is, only in the other rotation direction. Furthermore, the fifth roller 245 does not rotate when the first roller 41 rotates clockwise.

Figure 11B:
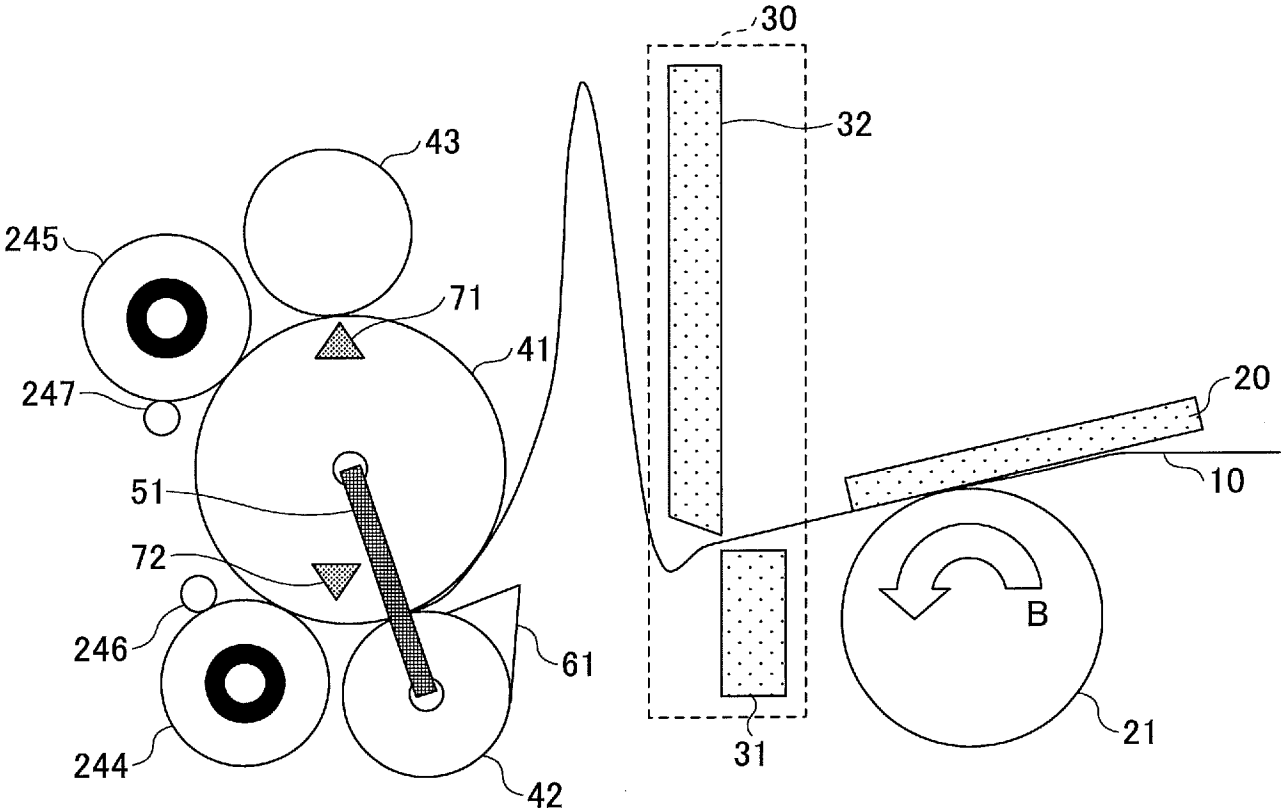
FIG. 11B is a diagram illustrating the method of discharging recording paper of a printer of the fifth embodiment.

Next, as illustrated in FIG. 11B, the rotation of the first roller 41 is stopped with the thermal head 20 continuing to perform printing on the recording paper 10. In this state, the platen roller 21 rotates counterclockwise as indicated by arrow B, so that the recording paper 10 is conveyed through the cutter part 30 to the side on which the first roller 41 is provided. Because the first roller 41 is not rotating, however, the recording paper 10 remains between the first roller 41 and the cutter part 30. Thereafter, when printing on the recording paper 10 ends, the recording paper 10 is cut to a predetermined length in the cutter part 30.

Figure 11C:
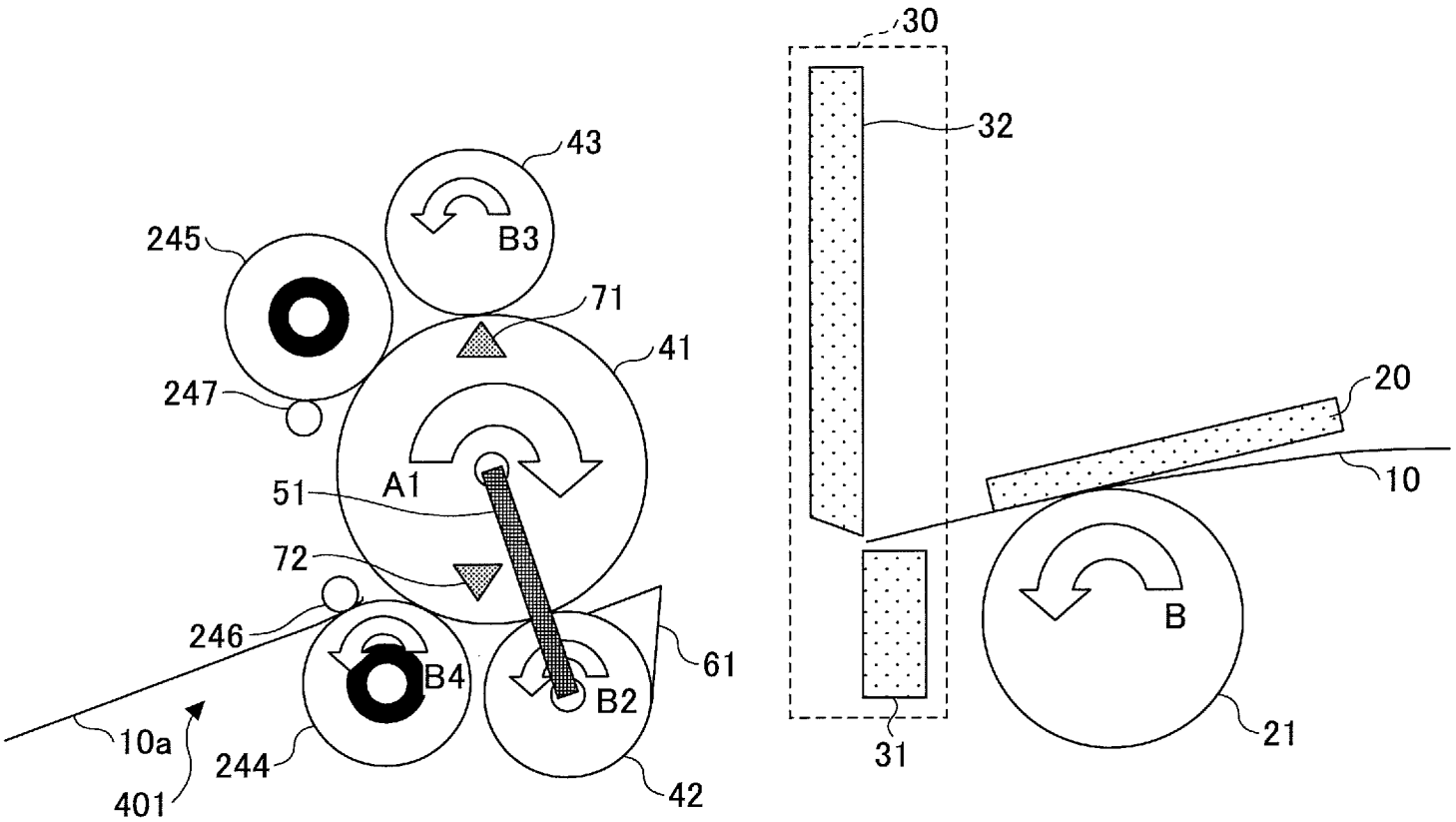
FIG. 11C is a diagram illustrating the method of discharging recording paper of a printer of the fifth embodiment.

Next, as illustrated in FIG. 11C, the recording paper 10*a* subjected to printing to be discharged from the first side is conveyed by rotating the first roller 41 clockwise as indicated by arrow A1. Specifically, the second roller 42 is rotated counterclockwise as indicated by arrow B2 and the fourth roller 244 is rotated counterclockwise as indicated by arrow B4 by rotating the first roller 41 clockwise as indicated by arrow A1. As a result, the recording paper 10*a* subjected to printing is conveyed to the first side (the first discharge opening 401) between the first roller 41 and the second roller 42 and between the first roller 41 and the fourth roller 244. The rotation of the first roller 41 is stopped with the recording paper 10*a* to be discharged from the first side being held between the fourth roller 244 and the first assist roller 246, and the recording paper 10*a* is kept ready to be removed, that is, held between the fourth roller 244 and the first assist roller 246. In this state, there is no recording paper 10*a* between the first roller 41 and the fourth roller 244. As a result, a function as a presenter is executed with respect to the recording paper 10*a* to be discharged from the first side. In the method of controlling a printer of this embodiment, this process is executed in conjunction with the process illustrated in FIG. 11D with predetermined timing as described below.

Figure 11D:
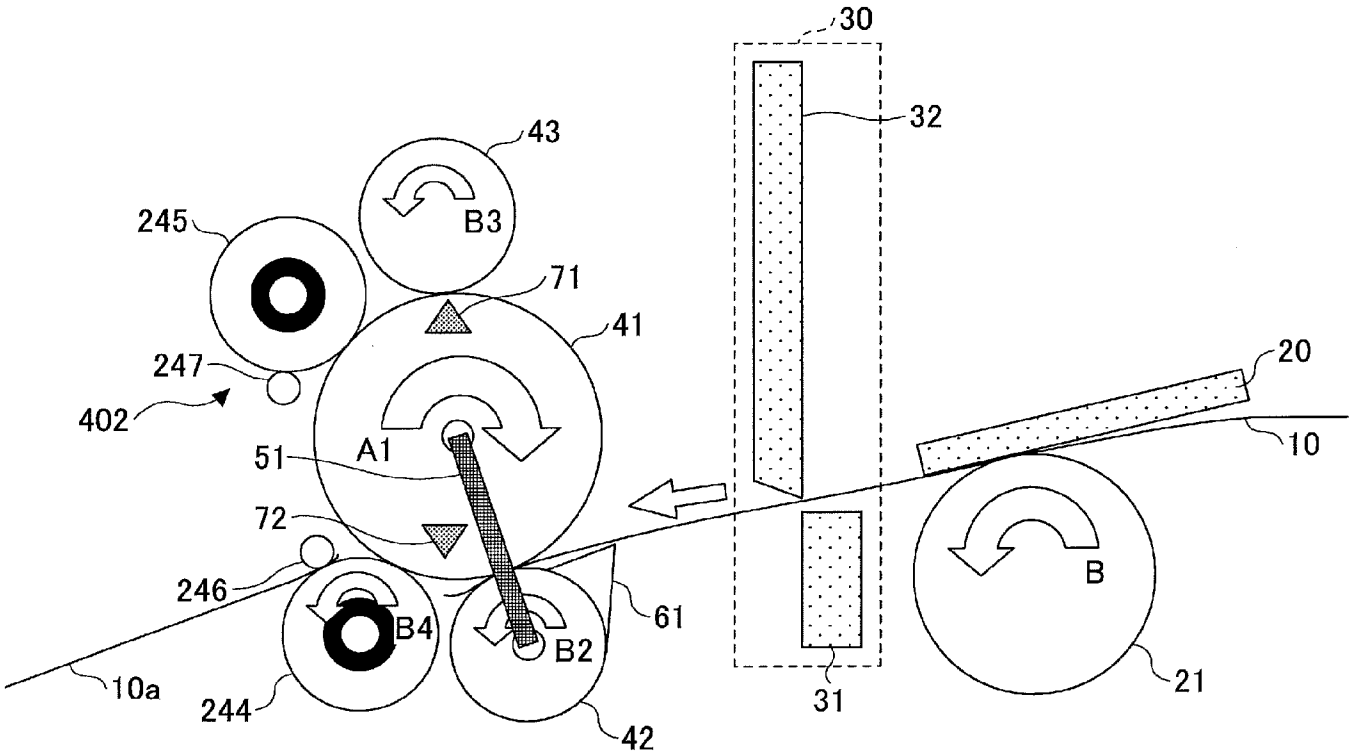
FIG. 11D is a diagram illustrating the method of discharging recording paper of a printer of the fifth embodiment.

Next, as illustrated in FIG. 11D, printing is performed on the recording paper 10 to be discharged from the second side (the second discharge opening 402). Specifically, when printing is performed on the recording paper 10 by the thermal head 20, the platen roller 21 rotates counterclockwise as indicated by arrow B, so that the recording paper 10 is conveyed through the cutter part 30 to the side on which the first roller 41 is provided. The second roller 42 is provided with the recording paper guide 61, and the recording paper 10 is conveyed along the recording paper guide 61 so as to enter between the first roller 41 and the second roller 42. That is, by rotating the first roller 41 clockwise as indicated by arrow A1, the second roller 42 rotates counterclockwise as indicated by arrow B2, so that it is possible to hold the recording paper 10 between the first roller 41 and the second roller 42. The rotation of the first roller 41 is stopped with an end of the recording paper 10 to be discharged from the second side thus being held between the first roller 41 and the second roller 42. It is assumed that at this point, at the same time, the recording paper 10*a* to be discharged from the first side is held and retained between the fourth roller 244 and the first assist roller 246 as illustrated in FIG. 11C or 11D. Accordingly, the conveyance of recording paper to be discharged from the first side and the conveyance of recording paper to be discharged from the second side are partly performed simultaneously with predetermined timing.

Figure 11E:
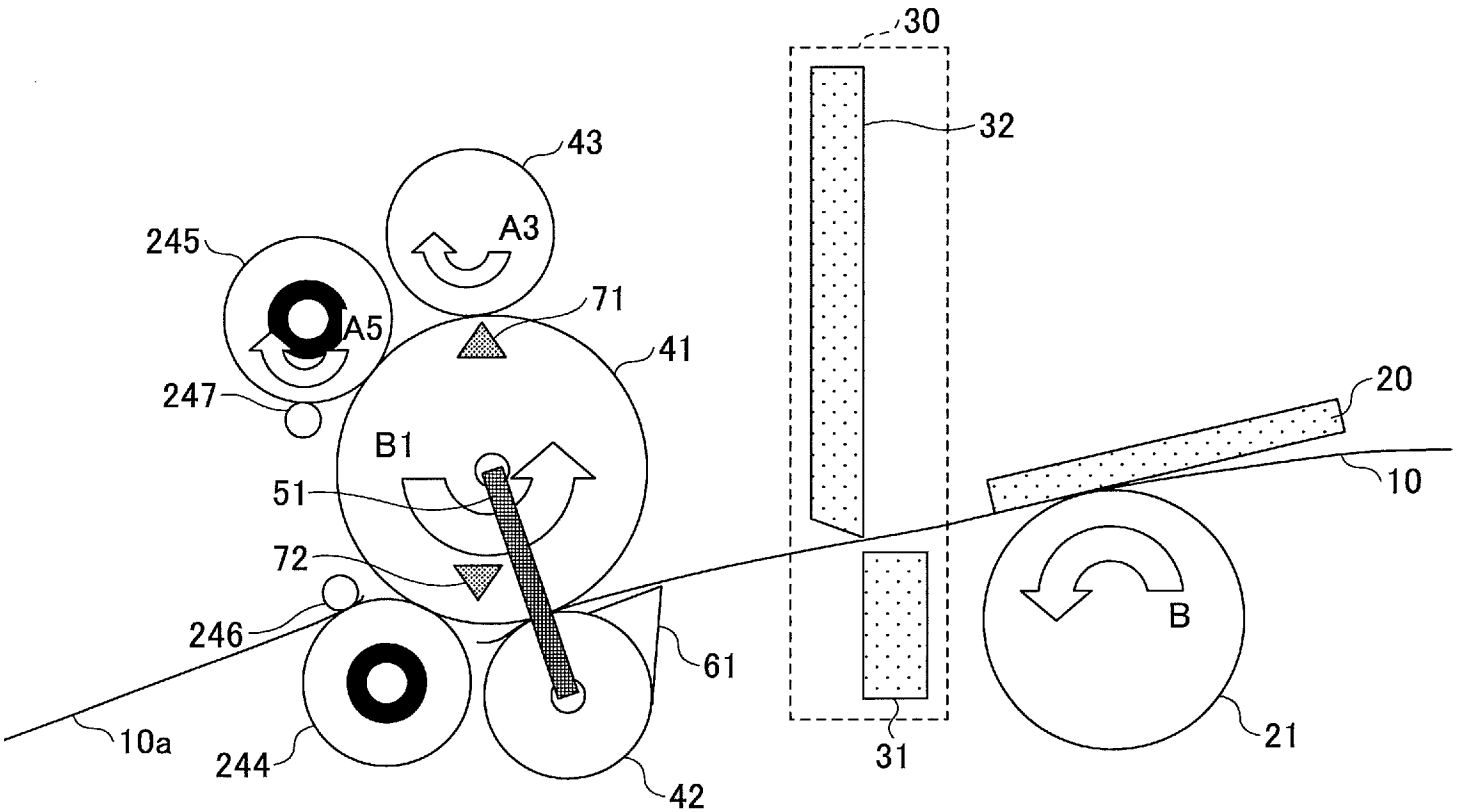
FIG. 11E is a diagram illustrating the method of discharging recording paper of a printer of the fifth embodiment.

Next, as illustrated in FIG. 11E, the first roller 41 is rotated counterclockwise as indicated by arrow B1. As a result, the second roller 42, whose center is connected to the center of the first roller 41 by the connecting arm 51, moves counterclockwise on the outer periphery of the first roller 41 with part of the recording paper 10 being held between the first roller 41 and the second roller 42. Specifically, the second roller 42 moves until the recording paper guide 61 provided on the second roller 42 comes into contact with the third roller 43 through the recording paper 10. By rotating the first roller 41 counterclockwise as indicated by arrow B1, the third roller 43 rotates clockwise as indicated by arrow A3. As a result, an end portion of the recording paper 10, which is brought into contact with the third roller 43 by the recording paper guide 61, is held between the first roller 41 and the third roller 43. At this point, the fourth roller 244, which is a roller that rotates only counterclockwise, does not rotate when the first roller 41 rotates counterclockwise. Accordingly, the recording paper 10*a* to be discharged from the first side is held and is kept retained between the fourth roller 244 and the first assist roller 246.

Figure 11F:
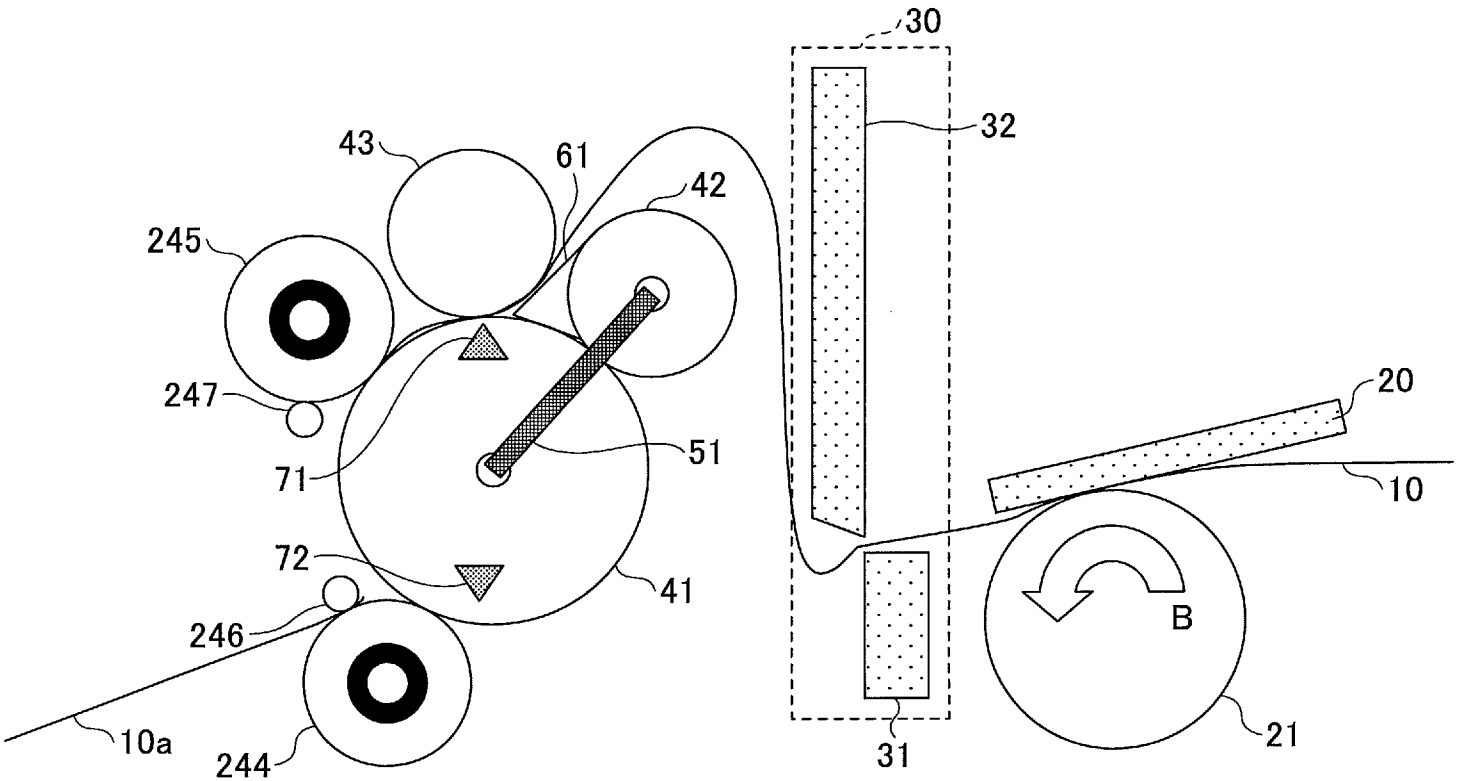
FIG. 11F is a diagram illustrating the method of discharging recording paper of a printer of the fifth embodiment.

Next, as illustrated in FIG. 11F, the thermal head 20 continues to perform printing on the recording paper 10 with the rotation of the first roller 41 being stopped. In this state, the platen roller 21 rotates counterclockwise as indicated by arrow B so as to convey the recording paper 10 through the cutter part 30 to the side on which the first roller 41 is provided. Because the first roller 41 is not rotating, however, the recording paper 10 remains between the first roller 41 and the cutter part 30. Thereafter, after printing on the recording paper 10 ends, the recording paper 10 is cut to a predetermined length in the cutter part 30. At this point, because the first roller 41 is not rotating, the fourth roller 244 does not rotate, either, so that the recording paper 10*a* to be discharged from the first side is held and is kept retained between the fourth roller 244 and the first assist roller 246.

Figure 11G:
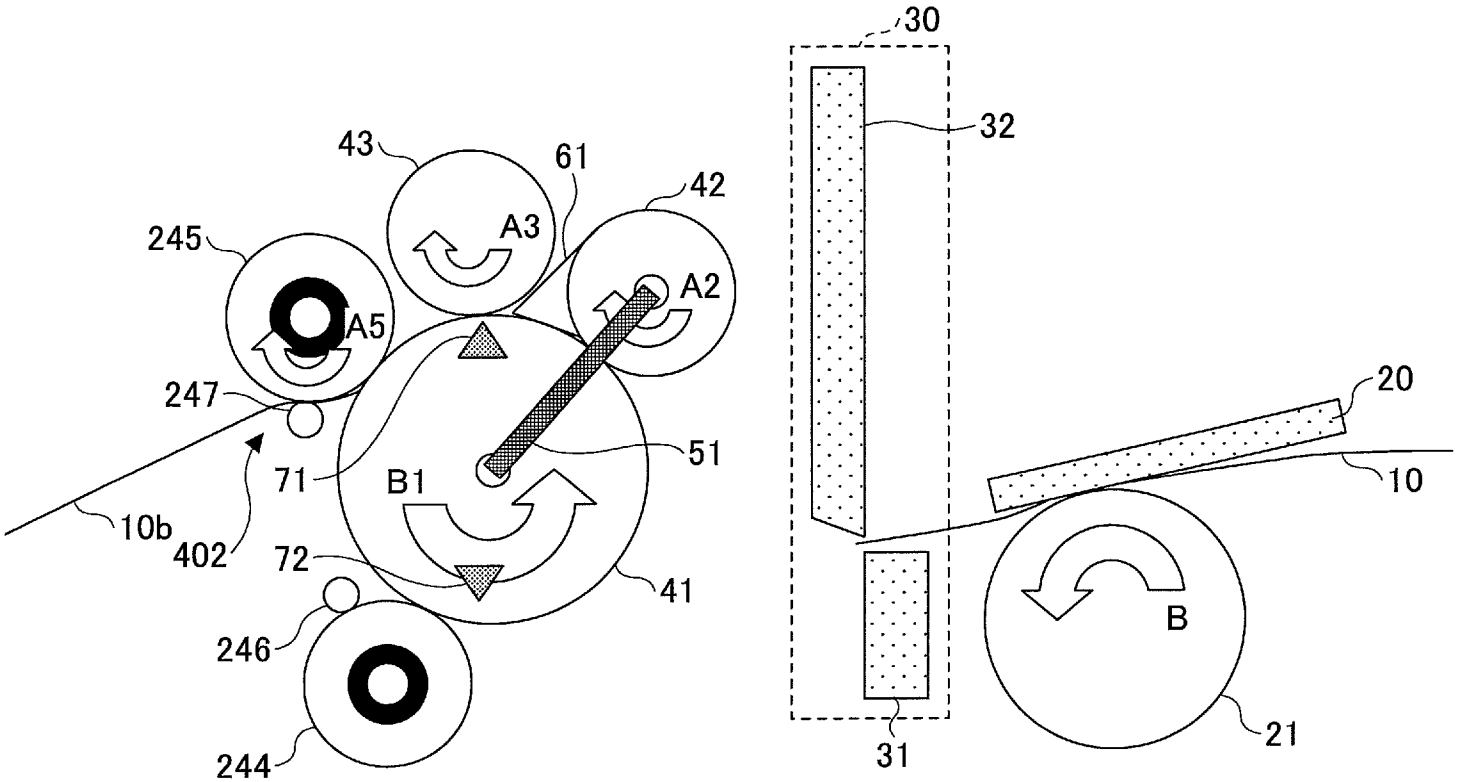
FIG. 11G is a diagram illustrating the method of discharging recording paper of a printer of the fifth embodiment.

Next, as illustrated in FIG. 11G, by rotating the first roller 41 counterclockwise as indicated by arrow B1, the recording paper 10*b* to be discharged from the second side is conveyed. Specifically, by rotating the first roller 41 counterclockwise as indicated by arrow B1, the third roller 43 is rotated clockwise as indicated by arrow A3, and the fifth roller 245 is rotated clockwise as indicated by arrow A5. As a result, the recording paper 10*b* subjected to printing is conveyed to the second side (the second discharge opening 402) between the first roller 41 and the third roller 43 and between the first roller 41 and the fifth roller 245. The conveyed recording paper 10*b* to be discharged from the second side stops, being held between the fifth roller 245 and the second assist roller 247, to be ready to be removed, that is, retained by the fifth roller 245 and the second assist roller 247. As a result, a function as a presenter is executed with respect to the recording paper 10*b* to be discharged from the second side. In this state, there is no recording paper 10*b* between the first roller 41 and the fifth roller 245. Furthermore, it is assumed that the recording paper 10*a* to be discharged from the first side has been removed by the time the recording paper 10*b* is retained by the fifth roller 245 and the second assist roller 247. Even when the recording paper 10*a* to be discharged from the first side has not been removed, however, the fourth roller 244 does not rotate because the fourth roller 244 is a roller that rotates only counterclockwise. Accordingly, the recording paper 10*a* to be discharged from the first side is held and kept retained between the first roller 41 and the fourth roller 244. Furthermore, in this embodiment, the fifth roller 245 is a clutch roller that does not rotate counterclockwise and rotates only clockwise as indicated by arrow A5, that is, only in the one rotation direction.

Figure 11H:
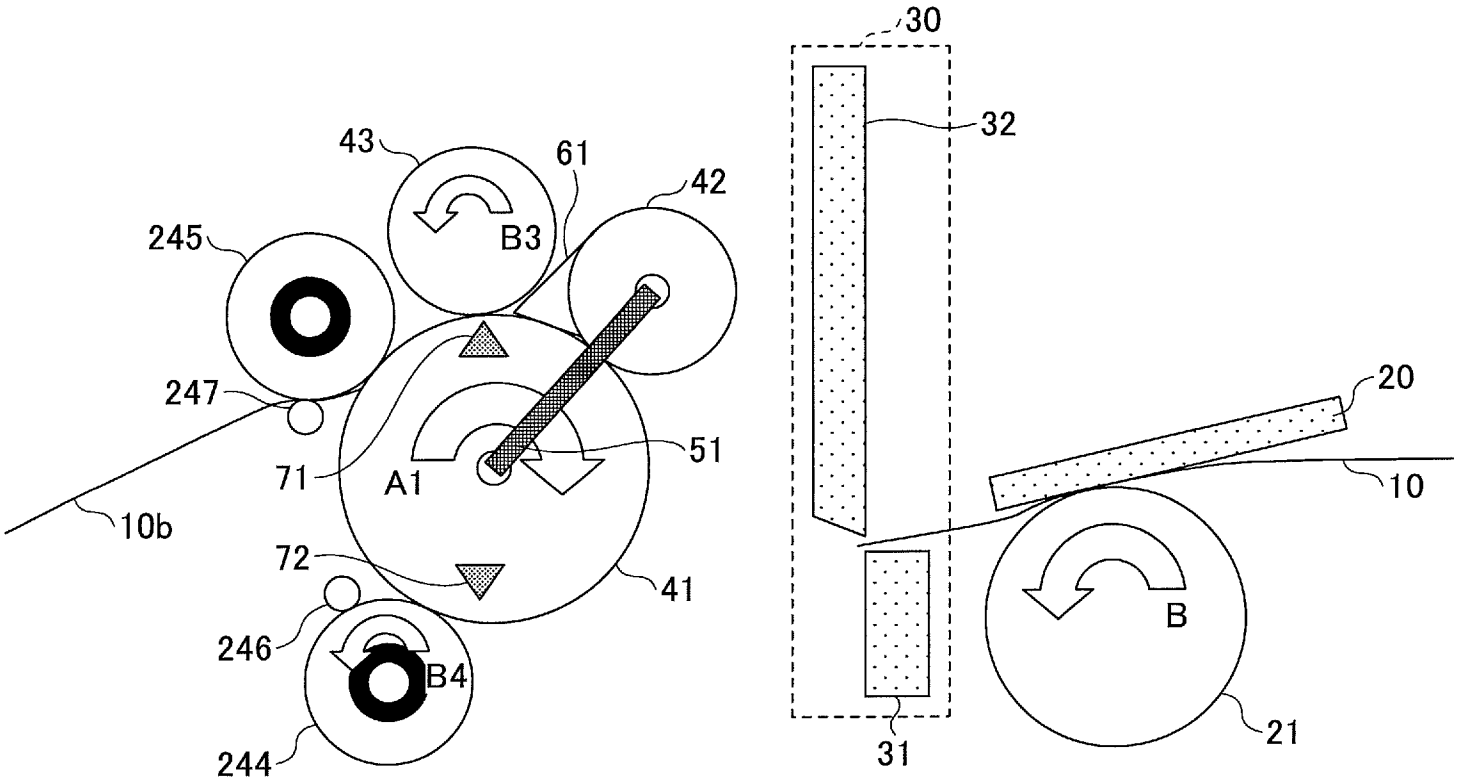
FIG. 11H is a diagram illustrating the method of discharging recording paper of a printer of the fifth embodiment.

Next, as illustrated in FIG. 11H, by rotating the first roller 41 clockwise as indicated by arrow A1, the second roller 42 is moved clockwise on the outer periphery of the first roller 41. It is assumed that the recording paper 10*a* to be discharged from the first side, held between the first roller 41 and the fourth roller 244, has been removed by the time the second roller 42 is moved as illustrated in FIG. 11H. The recording paper 10*a* to be discharged from the first side is forcibly discharged if not removed. At this point, the fifth roller 245 does not rotate, and the recording paper 10*b* to be discharged from the second side is held and retained between the fifth roller 245 and the second assist roller 247.

Figure 11I:
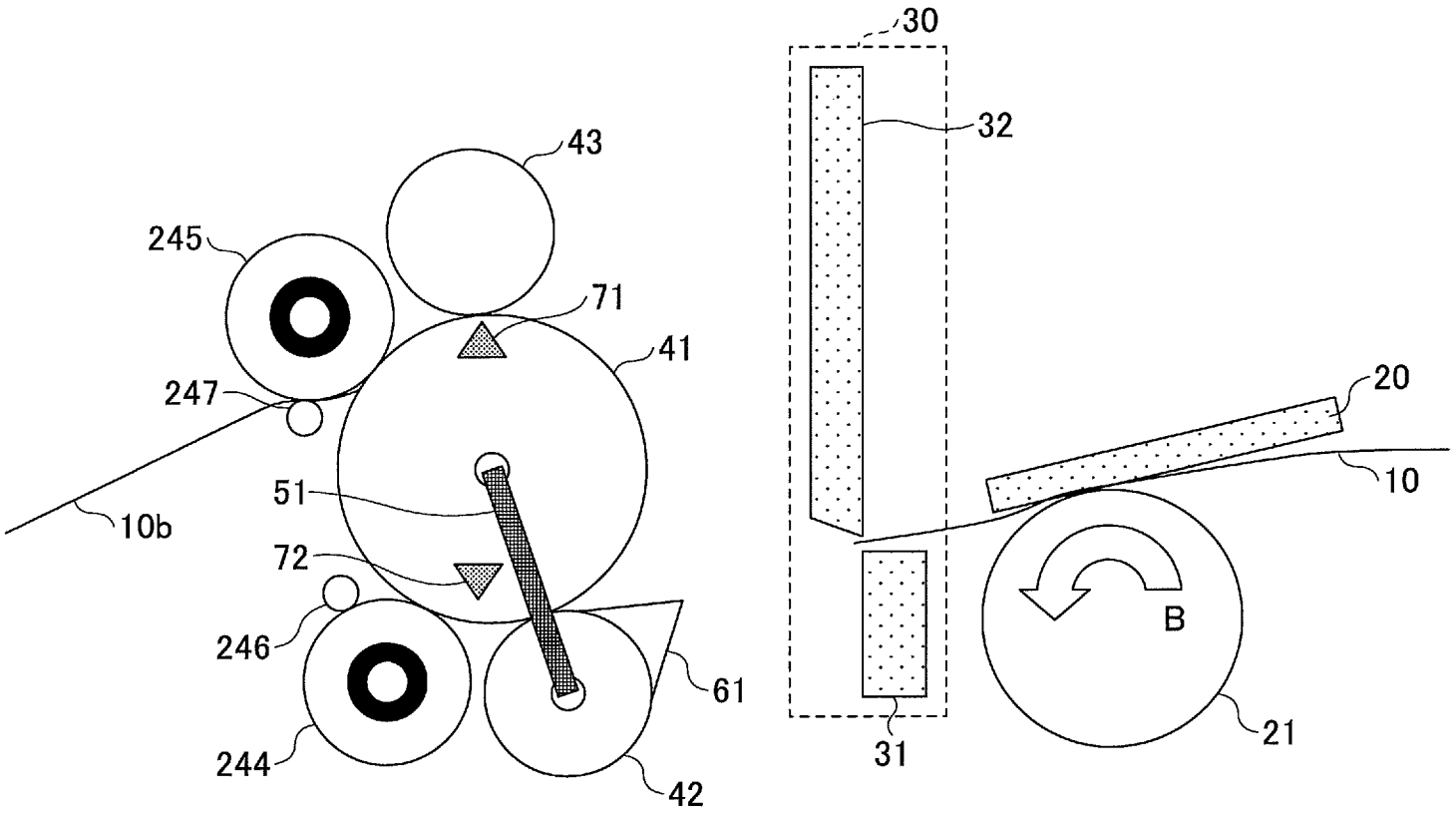
FIG. 11I is a diagram illustrating the method of discharging recording paper of a printer of the fifth embodiment.

Next, by further rotating the first roller 41 clockwise as indicated by arrow A1 from the state of FIG. 11H, the second roller 42 is moved to the vicinity of the fourth roller 244 as illustrated in FIG. 11I, and thereafter, the rotation of the first roller 41 is stopped.

Figure 11J:
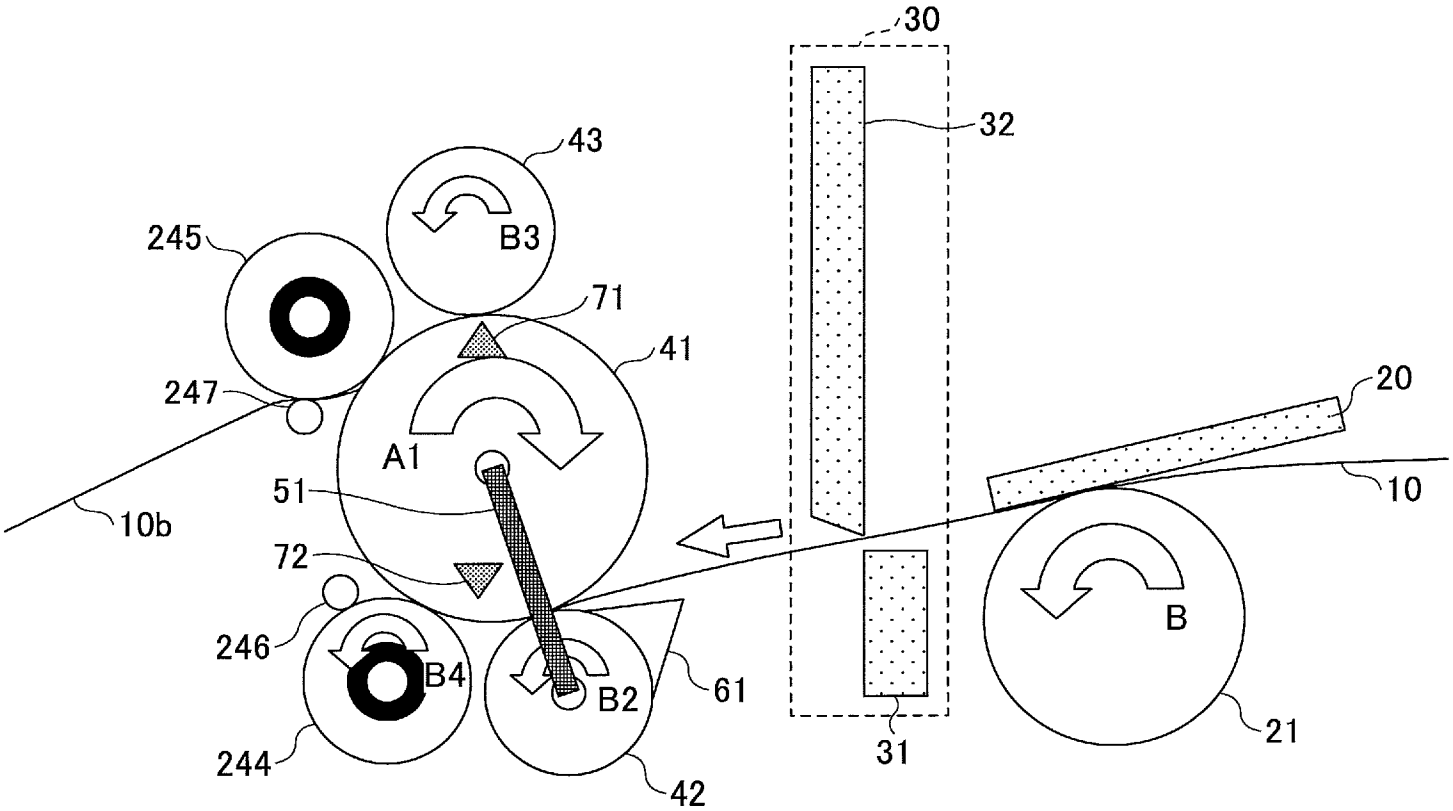
FIG. 11J is a diagram illustrating the method of discharging recording paper of a printer of the fifth embodiment.

Next, as illustrated in FIG. 11J, printing is performed on the next recording paper 10 to be discharged from the first side the same as in the case illustrated in FIG. 11A. Specifically, when printing is performed on the recording paper 10 by the thermal head 20, the platen roller 21 rotates counterclockwise as indicated by arrow B, so that the recording paper 10 is conveyed through the cutter part 30 to the side on which the first roller 41 is provided. The second roller 42 is provided with the recording paper guide 61, and the recording paper 10 is conveyed along the recording paper guide 61 so as to enter between the first roller 41 and the second roller 42. That is, by rotating the first roller 41 clockwise as indicated by arrow A1, the second roller 42 rotates counterclockwise as indicated by arrow B2, so that it is possible to hold the recording paper 10 between the first roller 41 and the second roller 42. At this point, the third roller 43 rotates counterclockwise as indicated by arrow B3, and the fourth roller 244 rotates counterclockwise as indicated by arrow B4 in contact with the first roller 41. Furthermore, the fifth roller 245 does not rotate when the first roller 41 rotates clockwise. Therefore, the cut recording paper 10*b* is kept retained between the fifth roller 245 and the second assist roller 247.

Figure 11K:
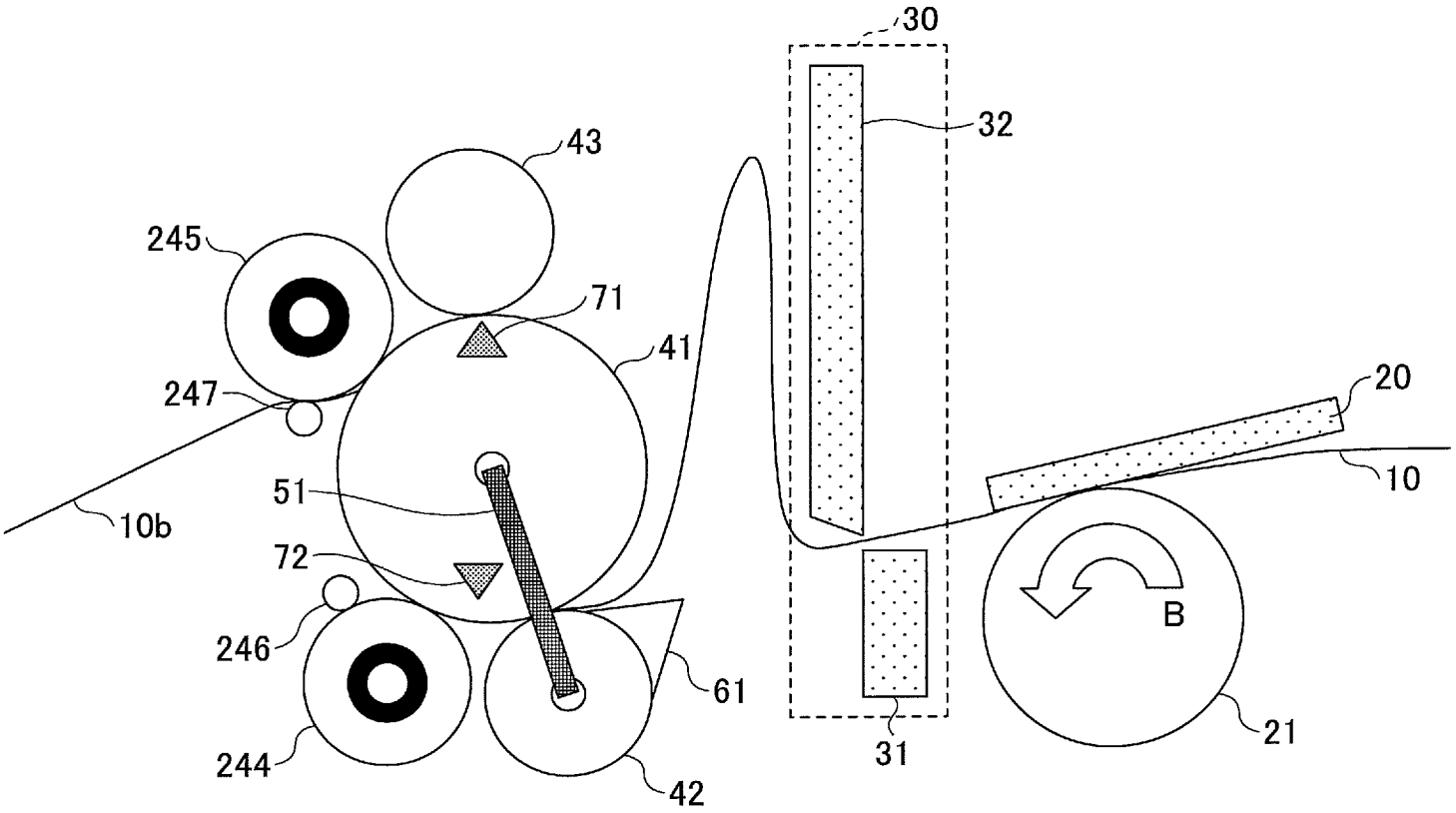
FIG. 11K is a diagram illustrating the method of discharging recording paper of a printer of the fifth embodiment.

Next, as illustrated in FIG. 11K, the rotation of the first roller 41 is stopped with the thermal head 20 continuing to perform printing on the recording paper 10 the same as in the case illustrated in FIG. 11B. In this state, when printing is performed on the recording paper 10 by the thermal head 20, the platen roller 21 rotates counterclockwise as indicated by arrow B, so that the recording paper 10 is conveyed through the cutter part 30 to the side on which the first roller 41 is provided. Because the first roller 41 is not rotating, however, the recording paper 10 remains between the first roller 41 and the cutter part 30. Thereafter, after printing on the recording paper 10 ends, the recording paper 10 is cut in the cutter part 30. Thereafter, the same process as the process illustrated in and after FIG. 11C is executed.

In this embodiment, with recording paper to be discharged from the first side being presented, recording paper to be discharged from the second side is subjected to printing and gets ready to be presented. Therefore, it is possible to reduce time between presenting recording paper to be discharged from the first side and presenting recording paper to be discharged from the second side, so that it is possible to discharge recording paper in a short time.

Furthermore, while the case of alternately discharging recording paper to be discharged from the first side and recording paper to be discharged from the second side is described above, it is possible to discharge recording paper from different discharge openings depending on the type of recording paper to be discharged by, for example, letting the first side be a discharge opening from which a receipt is discharged and letting the second side be a discharge opening from which a voucher is discharged, so that it is possible to increase the convenience and functionality of a printer.

Figure 12:
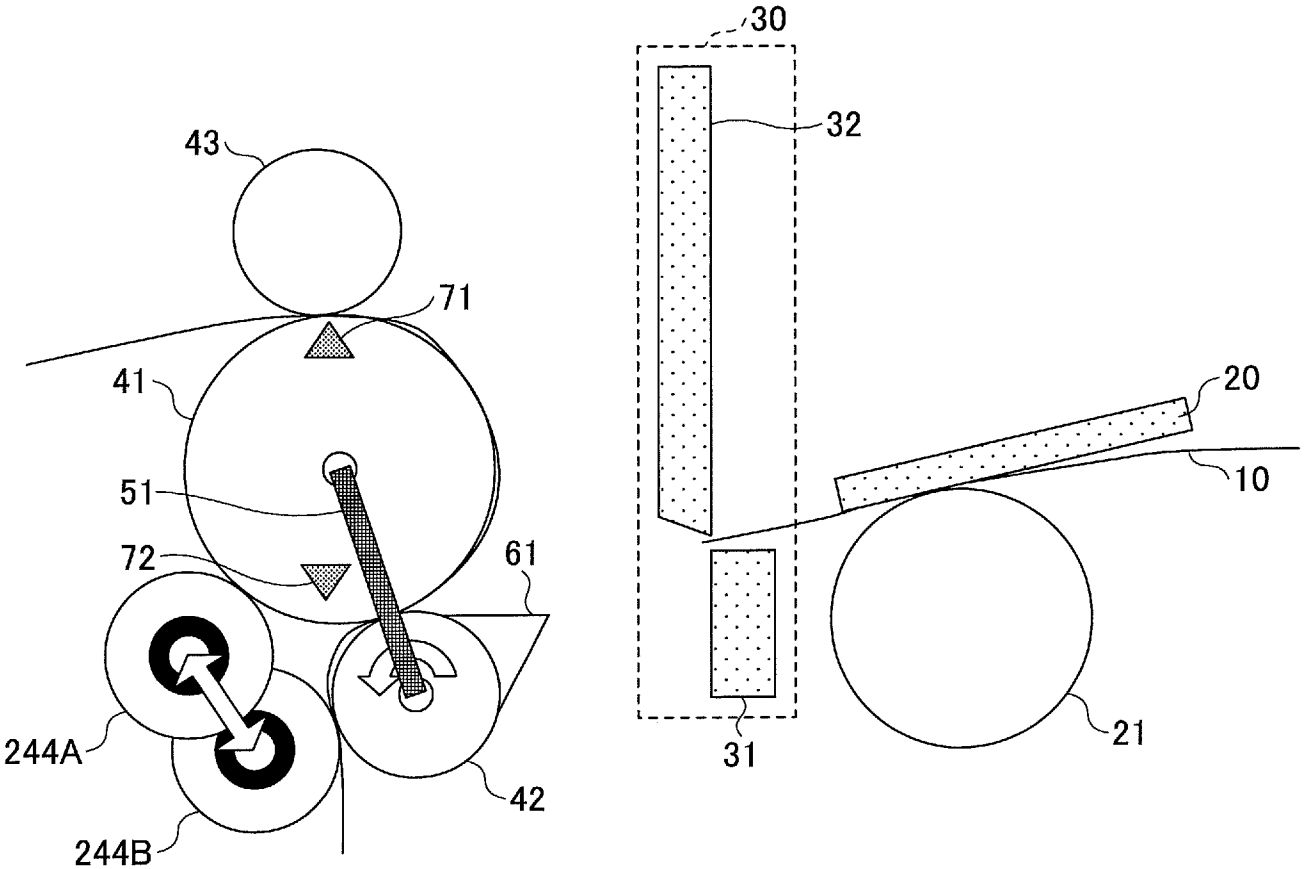
FIG. 12 is a diagram illustrating a structure of a printer of the fifth embodiment.

The printer of this embodiment may be capable of switching the position of the fourth roller 244 between a position 244A where the fourth roller 244 is brought into contact with the first roller 41 and a position 244B where the fourth roller 244 is brought into contact with the second roller 42 as illustrated in FIG. 12. By bringing the fourth roller 244 into contact with the first roller 41, it is possible for the printer to operate as a presenter. Furthermore, by bringing the fourth roller 244 into contact with the second roller 42, it is possible for the printer to operate as a retractor. In this case, the fourth roller 244 is not a clutch roller but a roller that rotates bi-directionally. As a result, the printer of this embodiment has the same function as the printer of the first embodiment. Furthermore, although not illustrated in the drawings, the printer may also be likewise capable of switching the position of the fifth roller 245 between a position where the fifth roller 245 is brought into contact with the first roller 41 and a position where the fifth roller 245 is brought into contact with the third roller 243. In this case, the fifth roller 245 is not a clutch roller but a roller that rotates bi-directionally. Furthermore, it is also possible to perform the same operation as in the third embodiment by changing the control method.

Sixth Embodiment

Next, a sixth embodiment is described. This embodiment relates to a method of controlling a printer of the fifth embodiment. In order to describe a method of controlling a printer of this embodiment, a structure of a printer of this embodiment is described based on FIG. 13. This printer includes the first sensor S1 and the second sensor S2 that detect the presence or absence of entry of the recording paper 10 from the cutter part 30. The first sensor S1 is a reflective sensor, and the second sensor S2 is a sensor that detects transmitted light. It is possible to determine the conditions of the recording paper 10 such as the presence or absence of the recording paper 10 and the paper quality of the recording paper 10 with the first sensor S1 and the second sensor S2. Furthermore, the printer includes the third sensor S3 for detecting whether the recording paper 10 is discharged from the first discharge opening 301, the fourth sensor S4 for detecting whether the recording paper 10 is discharged from the second discharge opening 302, the fifth sensor S5 for detecting whether the recording paper 10 is discharged from the third discharge opening 303, and the sixth sensor S6 for detecting whether the recording paper 10 is retracted. Furthermore, the printer includes the seventh sensor S7 and the eighth sensor S8 for detecting the position of the connecting arm 51 connecting the first roller 41 and the second roller 42. The fourth sensor S4 of this embodiment corresponds to the sensor 71 of the fifth embodiment, and the third sensor S3 of this embodiment corresponds to the sensor 72 of the fifth embodiment. Furthermore, the printer is provided with the first assist roller 246 and the second assist roller 247 in addition to the first roller 41, the second roller 42, the third roller 43, the fourth roller 244, and the fifth roller 245. The sensors may be disposed at any positions as long as it is possible to perform desired detections.

Figure 13:
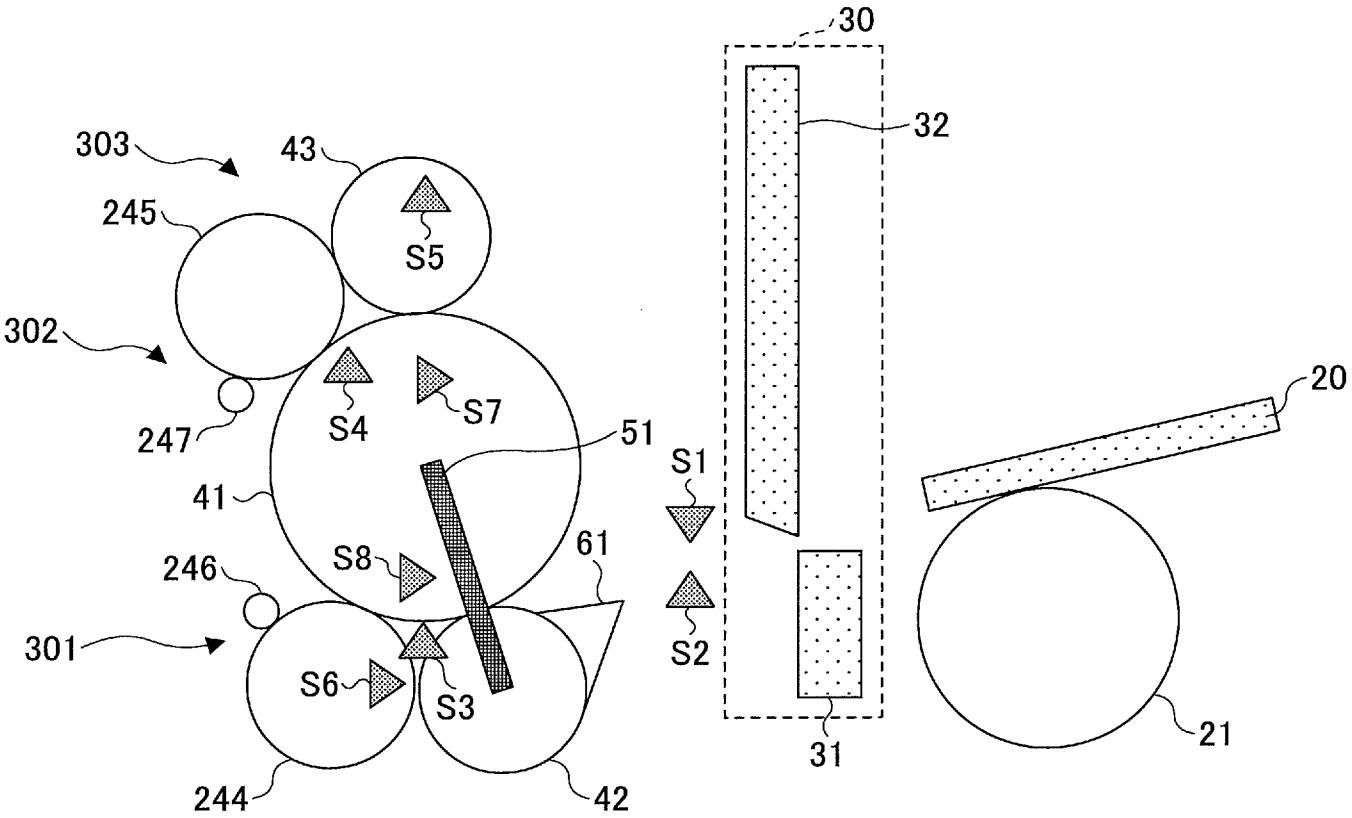
FIG. 13 is a diagram illustrating a printer of a sixth embodiment.
Figure 14A:
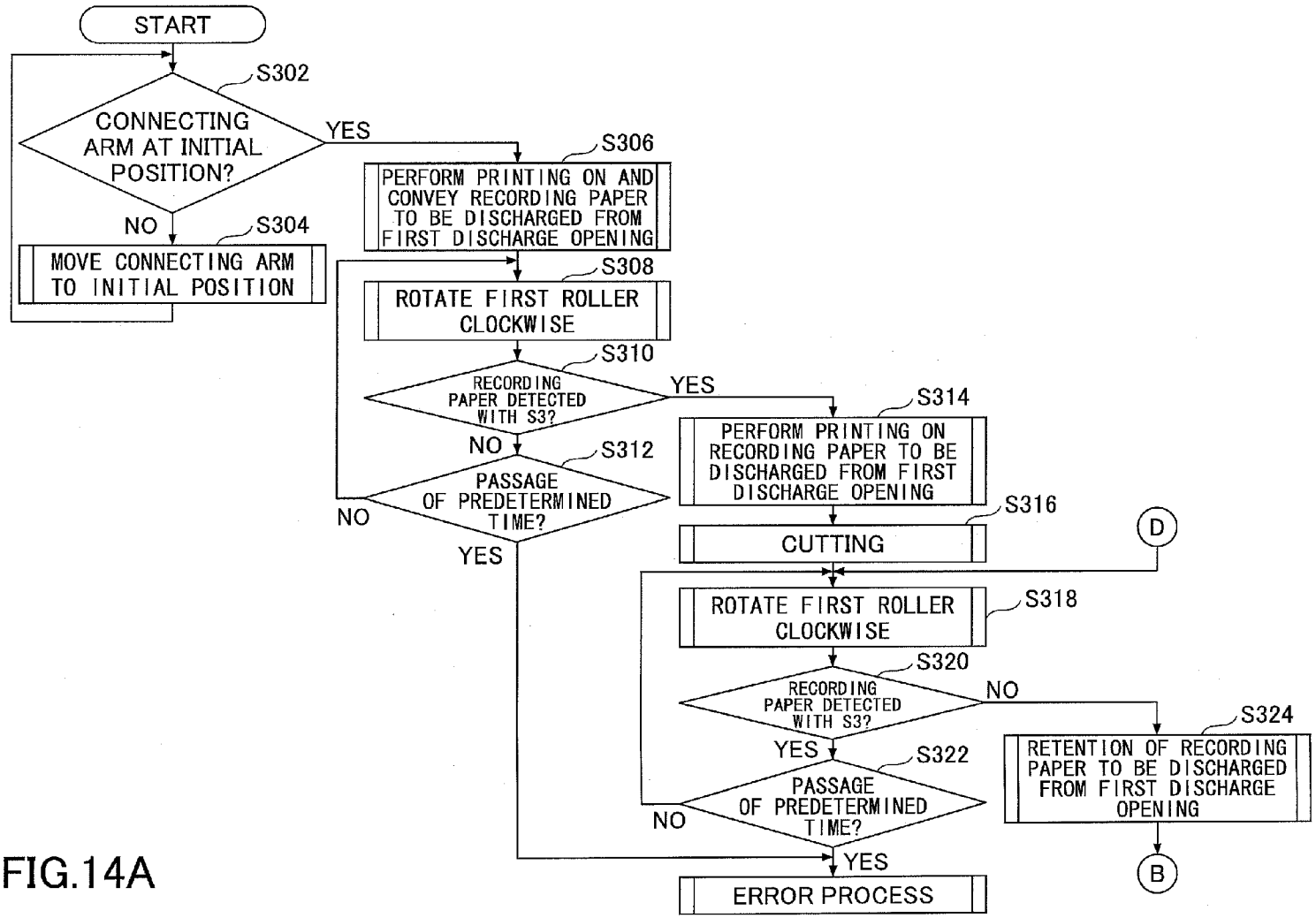
FIG. 14A is a flowchart of a method of controlling a printer of the sixth embodiment.
Figure 14B:
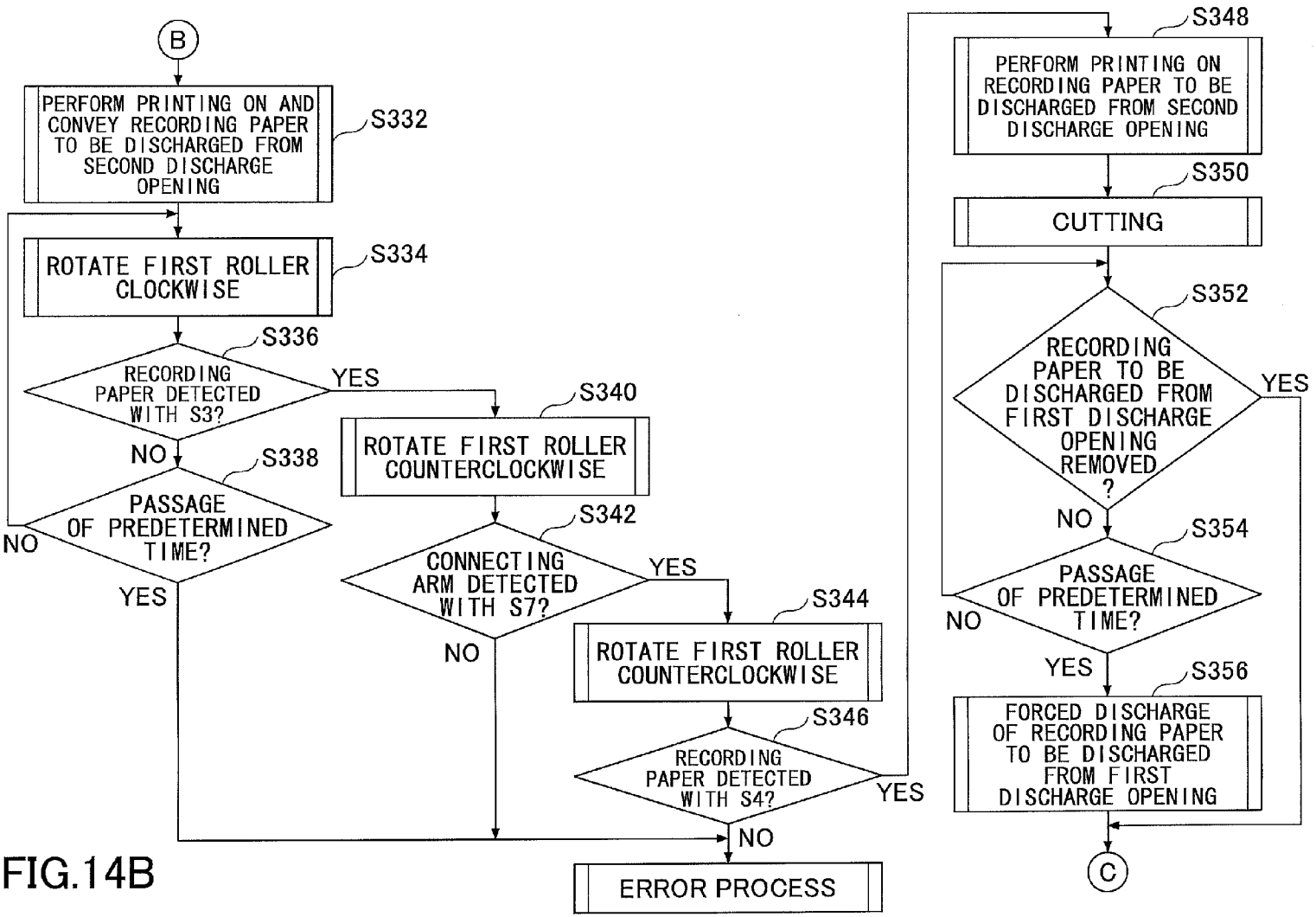
FIG. 14B is a flowchart of the method of controlling a printer of the sixth embodiment.
Figure 14C:
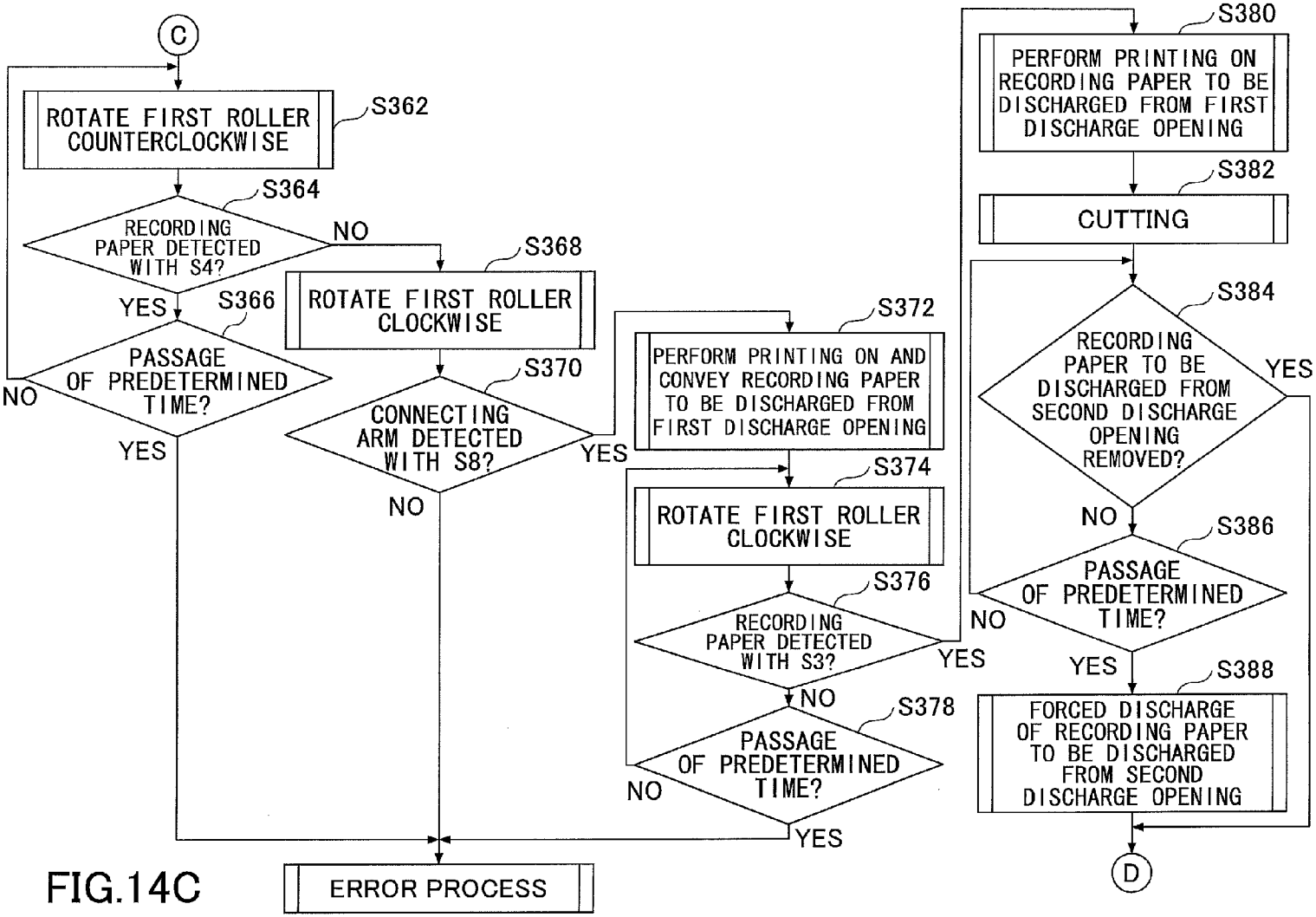
FIG. 14C is a flowchart of the method of controlling a printer of the sixth embodiment.
Figure 15:
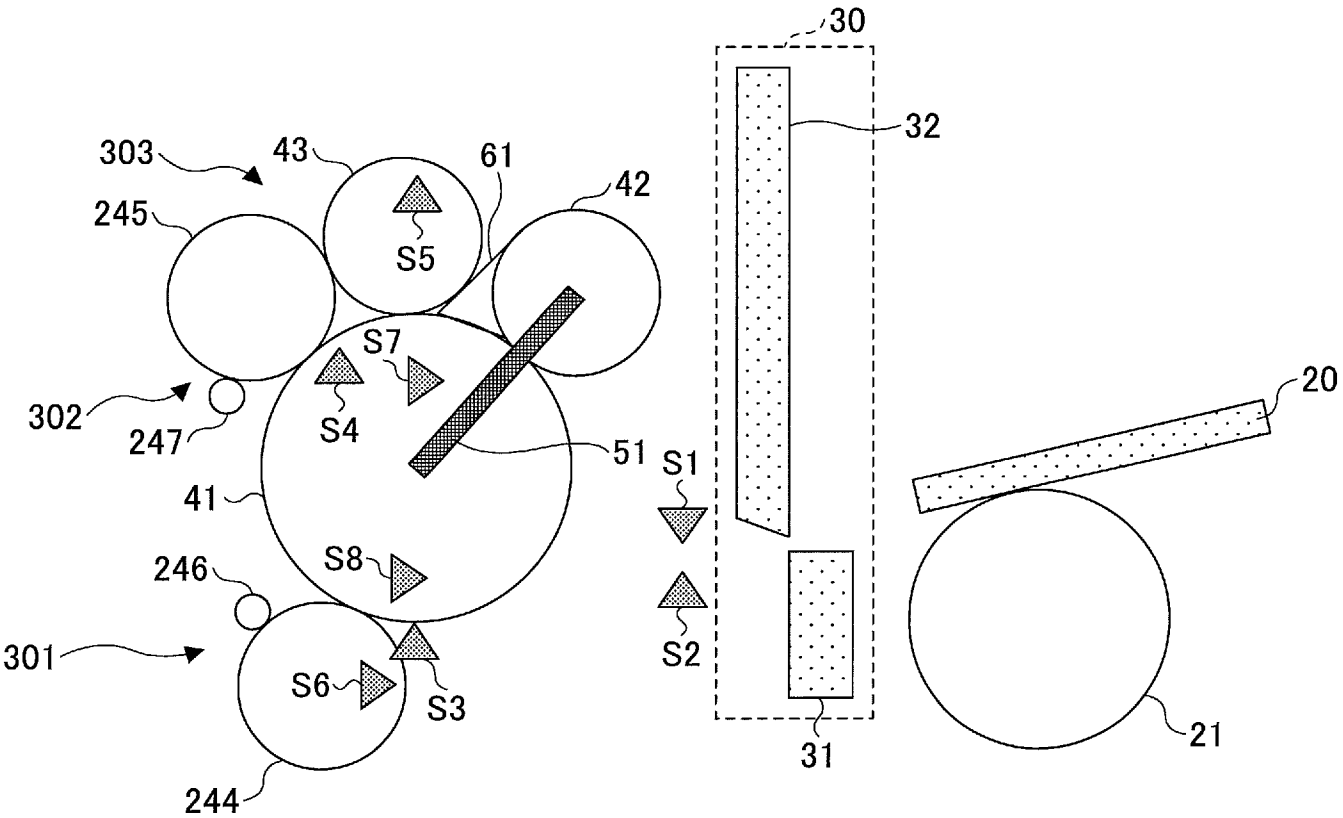
FIG. 15 is a diagram illustrating a printer of the sixth embodiment.

A method of controlling a printer of this embodiment is described based on FIGS. 13 through 15. As illustrated in FIG. 13, in this embodiment, the recording paper to be discharged from the first side (the first discharge opening 401 in FIG. 11A) in the fifth embodiment is determined as recording paper to be discharged from the first discharge opening 301, and the recording paper to be discharged from the second side (the second discharge opening 402 in FIG. 11A) is determined as recording paper to be discharged from the second discharge opening 302. Furthermore, like in the fifth embodiment, the recording paper 10 cut in the cutter part 30 and discharged from the first side (the first discharge opening 301) is denoted by reference numeral 10*a*, and the recording paper 10 cut in the cutter part 30 and discharged from the second side (the second discharge opening 302) is denoted by reference numeral 10*b* for convenience of description.

First, at step S302 of FIG. 14A, it is determined whether the connecting arm 51 is at a predetermined initial position. The connecting arm 51 is referred to as being at a predetermined initial position when, for example, the connecting arm 51 is positioned so as to cause the second roller 42 to be below the first roller 41 as illustrated in FIG. 13. Whether the connecting arm 51 is at an initial position may be determined by whether the eighth sensor S8 detects the connecting arm 51 or not. If the connecting arm 51 is detected by the eighth sensor S8 so that it is determined that the connecting arm 51 is at an initial position (YES at step S302), the process proceeds to step S306. On the other hand, if the connecting arm 51 is not detected by the eighth sensor S8 so that it is determined that the connecting arm 51 is not at an initial position (NO at step S302), the process proceeds to step S304.

Next, at step S304, the connecting arm 51 is moved to the predetermined initial position, that is, a position where the connecting arm 51 is detected by the eighth sensor S8. Specifically, the connecting arm 51 is moved to the predetermined initial position by moving the second roller 42 in contact with the outer periphery of the first roller 41 clockwise by rotating the first roller 41 clockwise. If the connecting arm 51 is not detected by the eighth sensor S8 even after repeating this process several times, an error process is executed.

Next, at step S306, the recording paper 10 is conveyed. That is, printing is performed on the recording paper 10 to be discharged from the first discharge opening 301. At this point, because the platen roller 21 rotates counterclockwise, the recording paper 10 is conveyed through the cutter part 30 in a direction in which the first roller 41 that has a presenter function is provided.

Next, at step S308, the first roller 41 is rotated clockwise. As a result, it is possible to hold the recording paper 10 between the first roller 41 and the second roller 42.

Next, at step S310, the presence or absence of the recording paper 10 is determined by the third sensor S3. If the recording paper 10 is detected by the third sensor S3 (YES at step S310), it is determined that the recording paper 10 is held between the first roller 41 and the second roller 42, that is, the recording paper 10 is held as illustrated in FIG. 11A, so that the process proceeds to step S314. On the other hand, if the recording paper 10 is not detected by the third sensor S3 (NO at step S310), the process proceeds to step S312.

Next, at step S312, it is determined whether a predetermined time has passed. If it is determined that a predetermined time has passed (YES at step S312), an error process is executed. On the other hand, if it is determined that a predetermined time has not passed (NO at step S312), the process proceeds to step S308.

Next, at step S314, printing is performed on the recording paper 10 to be discharged from the first discharge opening 301 by the thermal head 20. As a result, the platen roller 21 rotates counterclockwise, and therefore, the recording paper 10 subjected to printing is conveyed so as to remain between the first roller 41 and the cutter part 30. Specifically, the recording paper 10 remains between the first roller 41 and the cutter part 30 as illustrated in FIG. 11B.

Next, at step S316, the recording paper 10 finished with printing is cut in the cutter part 30. As a result, the recording paper 10*a* to be discharged from the first discharge opening 301 is cut.

Next, at step S318, the first roller 41 is rotated clockwise. As a result the second roller 42 and the fourth roller 244 rotate counterclockwise, and the cut recording paper 10*a* is conveyed with the first roller 41 and the second roller 42 and with the first roller 41 and the fourth roller 244.

Next, at step S320, the presence or absence of the recording paper 10*a* is determined by the third sensor S3. If the recording paper 10*a* is detected by the third sensor S3 (YES at step S320), the process proceeds to step S322. On the other hand, if the recording paper 10*a* is not detected by the third sensor S3 (NO at step S320), it is determined that the recording paper 10*a* is held between the fourth roller 244 and the first assist roller 246, that is, the recording paper 10*a* is held as illustrated in FIG. 11C, and the process proceeds to step S324.

Next, at step S322, it is determined whether a predetermined time has passed. If it is determined that a predetermined time has passed (YES at step S322), an error process is executed. On the other hand, if it is determined that a predetermined time has not passed (NO at step S322), the process proceeds to step S318.

Next, at step S324, a process to retain the recording paper 10*a* to be discharged from the first discharge opening 301 is executed. Thereafter, the process proceeds to step S332 in FIG. 14B.

Next, at step S332 of FIG. 14B, the recording paper 10 is conveyed. Specifically, printing is performed on the recording paper 10 to be discharged from the second discharge opening 302. At this point, because the platen roller 21 rotates counterclockwise, the recording paper 10 is conveyed through the cutter part 30 in the direction in which the first roller 41 that has a presenter function is provided.

Next, at step S334, the first roller 41 is rotated clockwise. As a result, it is possible to hold the recording paper 10 between the first roller 41 and the second roller 42. At this point, as illustrated in FIG. 11D, the rotations of the platen roller 21 and the first roller 41 are controlled so that the recording paper 10*a* to be discharged from the first discharge opening 301 is kept held and retained between the fourth roller 244 and the first assist roller 246.

Next, at step S336, the presence or absence of the recording paper 10 is determined by the third sensor S3. If the recording paper 10 is detected by the third sensor S3 (YES at step S336), it is determined that the recording paper 10 is held between the first roller 41 and the second roller 42, that is, the recording paper 10 is held as illustrated in FIG. 11D, and the process proceeds to step S340. On the other hand, if the recording paper 10 is not detected by the third sensor S3 (NO at step S336), the process proceeds to step S338.

Next, at step S338, it is determined whether a predetermined time has passed. If it is determined that a predetermined time has passed (YES at step S338), an error process is executed. On the other hand, if it is determined that a predetermined time has not passed (NO at step S338), the process proceeds to step S334.

Next, at step S340, the first roller 41 is rotated counterclockwise. As a result, the second roller 42 connected by the connecting arm 51 rotates counterclockwise on the outer periphery of the first roller 41. In this process, it is assumed that the first roller 41 is rotated a predetermined angle or more, that is, more than or equal to an angle necessary for the second roller 42 to move to the position illustrated in FIG. 15. In this state, the third roller 43 is rotating clockwise. Furthermore, the fourth roller 244, which is a roller that rotates only unidirectionally, does not rotate clockwise, so that the recording paper 10*a* to be discharged from the first discharge opening 301 is kept held and retained between the fourth roller 244 and the first assist roller 246.

Next, at step S342, it is determined whether the connecting arm 51 is detected by the seventh sensor S7. If the connecting arm 51 is detected by the seventh sensor S7 (YES at step S342), the process proceeds to step S344. On the other hand, if the connecting arm 51 is not detected by the seventh sensor S7 (NO at step S342), an error process is executed.

Next, at step S344, the first roller 41 is rotated counterclockwise. As a result, the third roller 43 rotates clockwise, so that it is possible to hold an end portion of the recording paper 10 to be discharged from the second discharge opening 302 between the first roller 41 and the third roller 43.

Next, at step S346, the presence or absence of the recording paper 10 is determined by the fourth sensor S4. If the recording paper 10 is detected by the fourth sensor S4 (YES at step S346), it is determined that the recording paper 10 is held between the first roller 41 and the third roller 43, that is, the recording paper 10 is held as illustrated in FIG. 11F, and the process proceeds to step S348. On the other hand, if the recording paper 10 is not detected by the fourth sensor S4 (NO at step S346), an error process is executed.

Next, at step S348, a predetermined amount of printing is performed on the recording paper 10 to be discharged from the second discharge opening 302 by the thermal head 20. At this point, the rotation of the first roller 41 is stopped, and the platen roller 21 rotates counterclockwise. Therefore, the recording paper 10 subjected to printing is conveyed so as to remain between the first roller 41 and the cutter part 30.

Next, at step S350, the recording paper 10 finished with printing is cut in the cutter part 30. As a result, the recording paper 10*b* to be discharged from the second discharge opening 302 is cut.

Next, at step S352, it is determined whether the recording paper 10*a* to be discharged from the first discharge opening 301, that is, the recording paper 10*a* that is held between the fourth roller 244 and the first assist roller 246, is removed. If the recording paper 10*a* to be discharged from the first discharge opening 301 is removed (YES at step S352), the process proceeds to step S362 in FIG. 14C. On the other hand, if the recording paper 10*a* to be discharged from the first discharge opening 301 is not removed (NO at step S352), the process proceeds to step S354.

Next, at step S354, it is determined whether a predetermined time has passed. If it is determined that a predetermined time has passed (YES at step S354), the process proceeds to step S356. On the other hand, if it is determined that a predetermined time has not passed (NO at step S354), the process proceeds to step S352.

Next, at step S356, the recording paper 10*a* to be discharged from the first discharge opening 301 is forcibly discharged. Thereafter, the process proceeds to step S362 in FIG. 14C.

Next, at step S362 of FIG. 14C, the first roller 41 is rotated counterclockwise. As a result, the third roller 43 and the fifth roller 245 rotate clockwise, so that the recording paper 10*b* to be discharged from the second discharge opening 302 is conveyed with the first roller 41 and the third roller 43 and with the first roller 41 and the fifth roller 245 so as to be held between the fifth roller 245 and the second assist roller 247.

Next, at step S364, the presence or absence of the recording paper 10*b* is determined by the fourth sensor S4. If the recording paper 10*b* is not detected by the fourth sensor S4 (NO at step S364), it is determined that the recording paper 10*b* is held between the fifth roller 245 and the second assist roller 247, that is, the recording paper 10*b* is held as illustrated in FIG. 11G, and the process proceeds to step S368. On the other hand, if the recording paper 10*b* is detected by the fourth sensor S4 (YES at step S364), the process proceeds to step S366.

Next, at step S366, it is determined whether a predetermined time has passed. If it is determined that a predetermined time has passed (YES at step S366), an error process is executed. On the other hand, if it is determined that a predetermined time has not passed (NO at step S366), the process proceeds to step S362.

Next, at step S368, the first roller 41 is rotated clockwise as illustrated in FIG. 11H. As a result, the second roller 42 connected by the connecting arm 51 rotates clockwise on the outer periphery of the first roller 41. In this process, it is assumed that the first roller 41 is rotated a predetermined angle or more, that is, more than or equal to an angle necessary for the second roller 42 to move to the position illustrated in FIG. 13. In this state, the third roller 43 is rotating clockwise. Furthermore, the fifth roller 245, which is a roller that rotates only unidirectionally, does not rotate counterclockwise, so that the recording paper 10*b* to be discharged from the second discharge opening 302 is kept held and retained between the fifth roller 245 and the second assist roller 247.

Next, at step S370, it is determined whether the connecting arm 51 is detected by the eighth sensor S8. If the connecting arm 51 is detected by the eighth sensor S8 (YES at step S370), the process proceeds to step S372. On the other hand, if the connecting arm 51 is not detected by the eighth sensor S8 (NO at step S370), an error process is executed.

Next, at step S372, the recording paper 10 is conveyed. Specifically, printing is performed on the next recording paper 10 to be discharged from the first discharge opening 301. At this point, because the platen roller 21 rotates counterclockwise, the recording paper 10 is conveyed through the cutter part 30 in a direction in which the first roller 41 that has a presenter function is provided.

Next, at step S374, the first roller 41 is rotated clockwise. As a result, it is possible to hold the recording paper 10 between the first roller 41 and the second roller 42.

Next, at step S376, the presence or absence of the recording paper 10 is determined by the third sensor S3. If the recording paper 10 is detected by the third sensor S3 (YES at step S376), it is determined that the recording paper 10 is held between the first roller 41 and the second roller 42, that is, the recording paper 10 is held as illustrated in FIG. 11J, and the process proceeds to step S380. On the other hand, if the recording paper 10 is not detected by the third sensor S3 (NO at step S376), the process proceeds to step S378.

Next, at step S378, it is determined whether a predetermined time has passed. If it is determined that a predetermined time has passed (YES at step S378), an error process is executed. On the other hand, if it is determined that a predetermined time has not passed (NO at step S378), the process proceeds to step S374.

Next, at step S380, printing is performed on the next recording paper 10 to be discharged from the first discharge opening 301 by the thermal head 20. As a result, the platen roller 21 rotates counterclockwise, so that the recording paper 10 subjected to printing is conveyed so as to remain between the first roller 41 and the cutter part 30. Specifically, the recording paper 10 remains between the first roller 41 and the cutter part 30 as illustrated in FIG. 11K.

Next, at step S382, the recording paper 10 finished with printing is cut in the cutter part 30. As a result, the next recording paper 10 to be discharged from the first discharge opening 301 is cut.

Next, at step S384, it is determined whether the recording paper 10*b* to be discharged from the second discharge opening 302, that is, the recording paper 10*b* that is held between the fifth roller 245 and the second assist roller 247, is removed. If it is determined that the recording paper 10*b* to be discharged from the second discharge opening 302 is removed (YES at step S384), the process proceeds to step S318 in FIG. 14A. On the other hand, if it is determined that the recording paper 10*b* to be discharged from the second discharge opening 302 is not removed (NO at step S384), the process proceeds to step S386.

Next, at step S386, it is determined whether a predetermined time has passed. If it is determined that a predetermined time has passed (YES at step S386), the process proceeds to step S388. On the other hand, if it is determined that a predetermined time has not passed (NO at step S386), the process proceeds to step S384.

Next, at step S388, the recording paper 10*b* to be discharged from the second discharge opening 302 is forcibly discharged. Thereafter, the process proceeds to step S318 in FIG. 14A.

By the above, it is possible to discharge two sheets of recording paper from different discharge openings, that is, the first discharge opening 301 and the second discharge opening 302, in a short time. The configuration other than that described above is the same as in the second embodiment.

The present invention is not limited to the specifically disclosed embodiments, and variations and modifications may be made without departing from the scope of the present invention. The printers of the above-described embodiments may have the structures illustrated in the drawings turned upside down or may have a structure where the rotation direction is reversed, that is, the clockwise rotation is changed to the counterclockwise rotation and the counterclockwise rotation is changed to the clockwise rotation, with respect to rollers such as the first roller 41.

What is claimed is:

1. A printer, comprising:

a printing part that performs printing on recording paper;

a cutter that cuts the recording paper;

a first roller provided on a side to which the recording paper is discharged from the cutter;

a second roller, a third roller, a fourth roller, and a fifth roller that are in contact with the first roller and are rotated by a rotation of the first roller; and a connecting arm that connects a center of the first roller and a center of the second roller, wherein the recording paper is discharged between the first roller and the fourth roller or between the first roller and the fifth roller.

2. The printer as claimed in claim 1, wherein when the recording paper is discharged between the first roller and the fourth roller, the recording paper is discharged between the first roller and the fourth roller after going between the first roller and the second roller, and when the recording paper is discharged between the first roller and the fifth roller, the recording paper is discharged between the first roller and the fifth roller after going between the first roller and the third roller.

3. The printer as claimed in claim 1, wherein the second roller connected to the connecting arm is movable on an outer periphery of the first roller by the rotation of the first roller, in a case of rotating the first roller in a first rotation direction, the second roller moves in the first rotation direction on the outer periphery of the first roller, and in a case of rotating the first roller in a second rotation direction opposite to the first rotation direction, the second roller moves in the second rotation direction on the outer periphery of the first roller.

4. The printer as claimed in claim 1, wherein the fourth roller is a roller that does not rotate in a first rotation direction and rotates in a second rotation direction, and the fifth roller is a roller that does not rotate in the second rotation direction and rotates in the first rotation direction.

5. The printer as claimed in claim 1, further comprising:

a first assist roller that rotates by contacting the fourth roller; and a second assist roller that rotates by contacting the fifth roller, wherein the recording paper discharged between the first roller and the fourth roller is held and retained between the fourth roller and the first assist roller, and the recording paper discharged between the first roller and the fifth roller is held and retained between the fifth roller and the second assist roller.

6. The printer as claimed in claim 1, wherein a position of the fourth roller is switched between a first position where the fourth roller comes into contact with the first roller and a second position where the fourth roller comes into contact with the second roller.

7. The printer as claimed in claim 1, wherein a position of the fifth roller is switched between a first position where the fifth roller comes into contact with the first roller and a second position where the fifth roller comes into contact with the third roller.

8. A method of controlling a printer, comprising:

conveying first recording paper cut with a cutter between a first roller and a second roller and between the first roller and a fourth roller by rotating the first roller in a first rotation direction, wherein the first roller is provided on a side to which recording paper is discharged from the cutter part, the second roller is in contact with the first roller and is rotated by a rotation of the first roller, and a center of the second roller is connected to a center of the first roller;

moving the second roller on an outer periphery of the first roller by rotating the first roller in a second rotation direction opposite to the first rotation direction; and conveying second recording paper cut with the cutter between the first roller and a third roller and between the first roller and a fifth roller by rotating the first roller in the second rotation direction.

9. The method of controlling a printer as claimed in claim 8, further comprising:

holding and retaining the first recording paper discharged between the first roller and the fourth roller between the fourth roller and a first assist roller that rotates by contacting the fourth roller; and holding and retaining the second recording paper discharged between the first roller and the fifth roller between the fifth roller and a second assist roller that rotates by contacting the fifth roller.

10. The method of controlling a printer as claimed in claim 9, wherein the fourth roller is a roller that does not rotate in the first rotation direction and rotates in the second rotation direction, the fifth roller is a roller that does not rotate in the second rotation direction and rotates in the first rotation direction, in a case of moving the second roller on the outer periphery of the first roller by rotating the first roller in the second rotation direction opposite to the first rotation direction, the fourth roller does not rotate and retains the first recording paper between the fourth roller and the first assist roller, and in a case of moving the second roller on the outer periphery of the first roller by rotating the first roller in the first rotation direction, the fifth roller does not rotate and retains the second recording paper between the fifth roller and the second assist roller.

* * * * *